US005557964A

United States Patent [19]

Jessop et al.

[11] Patent Number: 5,557,964

[45] Date of Patent: Sep. 24, 1996

[54] DOUBLE PLANE BEND FORMER

[75] Inventors: Richard E. Jessop, DeWitt; John E. Demmer, Lansing, both of Mich.

[73] Assignee: Demmer Corporation, Lansing, Mich.

[21] Appl. No.: 547,019

[22] Filed: Oct. 23, 1995

Related U.S. Application Data

[62] Division of Ser. No. 183,675, Jan. 19, 1994, Pat. No. 5,481,897.

[51] Int. Cl.[6] ..... B21D 5/01

[52] U.S. Cl. ..... 72/389.1; 72/389.6; 72/381; 72/413

[58] Field of Search ..... 72/389.1, 389.6, 72/381, 413, 382

[56] References Cited

U.S. PATENT DOCUMENTS

| | | | |
|---|---|---|---|
| 1,276,639 | 8/1918 | Finegan | 72/413 |
| 1,776,082 | 9/1930 | Peterson | 72/413 |
| 2,966,934 | 1/1961 | Huet | 72/413 |
| 3,004,582 | 10/1961 | Key | 72/381 |
| 3,992,460 | 11/1975 | Jackson . | |
| 4,368,224 | 1/1983 | Jackson . | |
| 4,569,219 | 2/1986 | Threlkel et al. | 72/381 |
| 4,975,306 | 12/1990 | Jackson . | |
| 5,151,307 | 9/1992 | Jackson . | |

FOREIGN PATENT DOCUMENTS

| | | | |
|---|---|---|---|
| 592481 | 9/1978 | U.S.S.R. | 72/382 |

*Primary Examiner*—David Jones
*Attorney, Agent, or Firm*—Ian C. McLeod; Mary M. Moyne

[57] ABSTRACT

A bending apparatus (10) for use in bending moldings (300 and 301) having a decorative outer surface (308) is described. The bending apparatus includes an upper bending member (12) and a lower bending member (52) which are moved together to form intricate compound bends in the molding. The bending surface (14) of the upper bending member has a variable curvature which is controlled by adjustment units (38). The lower bending member includes first and second outer tool members (54 and 56) and a middle tool member (120). The moldings are mounted onto the holders (102) of the tool members during bending. The outer tool members pivot along two axis in response to the pressure of the upper bending member during bending. The middle tool member pivots along one axis and is compressed downward during bending. The bending apparatus allows double plane bends to be formed in the molding without damaging the decorative outer surface of the molding.

12 Claims, 12 Drawing Sheets

118
54
116
110A
C
102
102F
102A
A
110
102C
110B
104
A
108
102D
110C
102E
102B
102G
C
114
B
68
78A
80A
100
74
78B
78
70
112
92
72
90
117
106
100
96
76
80
82
80B
94
98
94B
90
98B
92
68B
84
98A
94C
94A
68
68A
58A
B
58C
66
60
58E
86
58D
58B
58

DOUBLE PLANE BEND FORMER

This is a divisional of application(s) Ser. No. 08/183,675 filed on Jan. 19, 1994, now U.S. Pat. No. 5,481,897.

BACKGROUND OF THE INVENTION (1) Field of the Invention

The present invention relates to an apparatus and method for bending an elongate strip particularly with a double plane bend. In particular, the present invention relates to an apparatus and method for providing compound bends in molding for the window of a vehicle having a decorative outer surface.

(2) Prior Art

Recently, molding for use on automotive vehicles has been manufactured with a decorative outer surface which corresponds in color to the color of the vehicle. One way to accomplish the correct color match is to add a thin color coated metal layer to the core substrate of the molding. This colored metal layer is attached to the molding during the manufacturing process and before the molding is bent. Bending the color matched molding has presented a problem. The colored layer is easily scratched or marred during the conventional bending process which dramatically effects the quality of the final product.

The prior art describes various types of moldings or weatherstrips for use on a vehicle having a colored outer surface. Illustrative are U.S. Pat. Nos. 3,922,460 to Jackson; 4,368,224 to Jackson; 4,975,306 to Jackson; and 5,151,307 to Jackson. The decorative outer surface of these moldings however is constructed of a non-metallic material such as a thermoplastic or PVC. The non-metallic layer is more resilient than a metal layer and thus is less likely to be damaged during a conventional bending process. The problem with using a non-metal material is that an exact color match cannot be achieved as between the colored non-metallic surface of the molding and the colored metal surface of the vehicle. Thus, there is a need for an apparatus and method for providing intricate and compound bends in a piece of molding having a colored metal outer layer which does not damage the colored finish of the outer layer.

OBJECTS

It is therefore particularly an object of the present invention to provide an apparatus for bending a molding having a colored outer surface which will not damage the colored surface. Further, it is an object of the present invention to provide a bending apparatus for bending the molding having a decorative outer coating for use with the windows of vehicles. Still further, it is an object of the present invention to provide a bending apparatus which will bend a vehicle molding along two different axis. Still further, it is an object of the present invention to provide a bending apparatus which will bend a molding having an intricate shape. Furthermore, it is an object of the present invention to provide a bending apparatus which will bend molding without stretching the molding. Still further, it is an object of the present invention to provide a bending apparatus which will provide consistent bends independent of the minute flows in the molding and independent of the number of molding bent. Further, it is an object of the present invention to provide a bending apparatus which is easily adjustable to achieve a variety of intricate bends. Finally, it is an object of the present invention to provide a bending apparatus which is able to provide intricate bends in molding at a high rate of speed.

DETAILED DESCRIPTION OF THE PREFERRED EMBODIMENTS

Figure 1A:
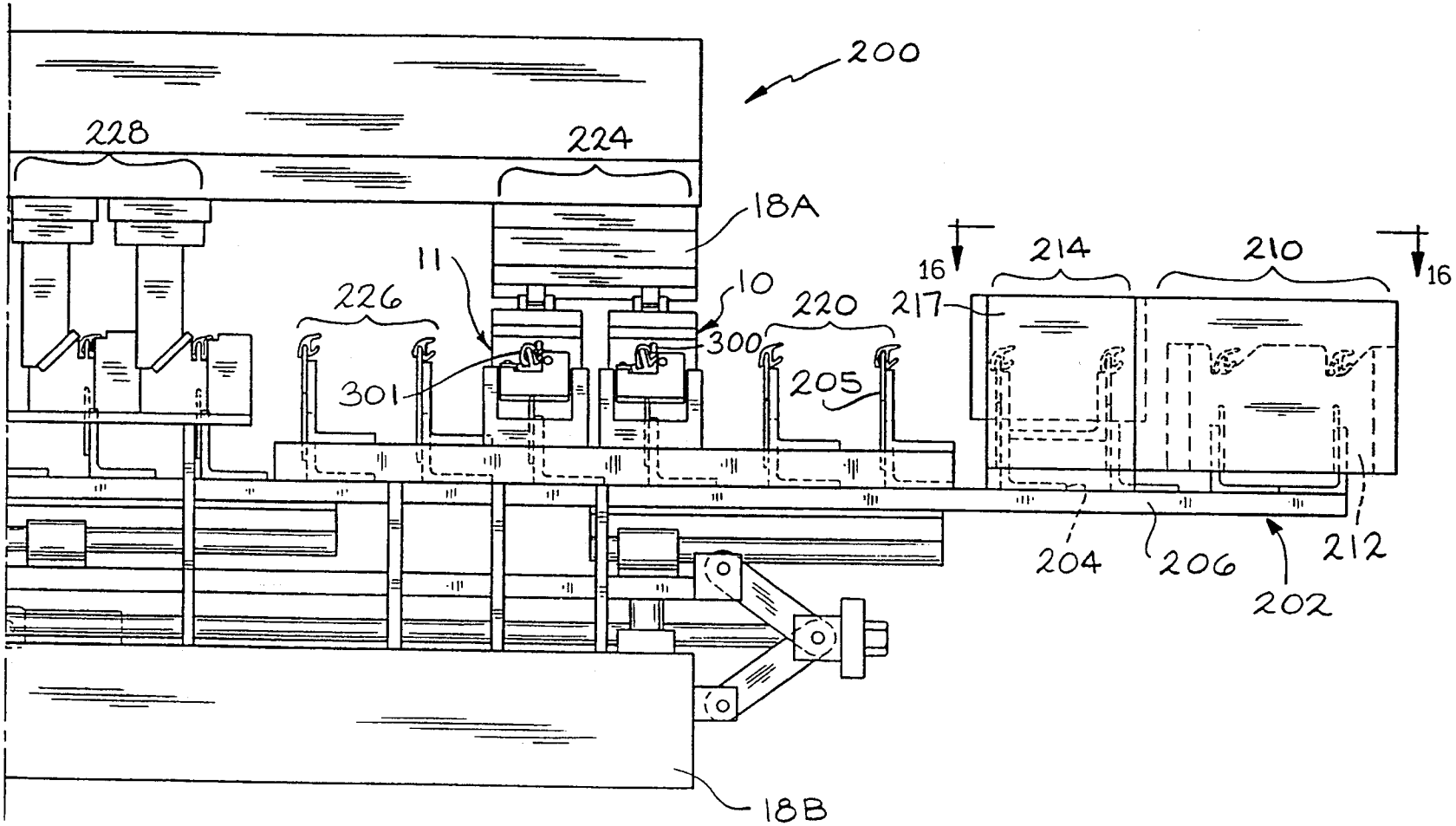
FIG. 1A is a side view of the bending and trimming system 200 showing the receiving station 210, the locating station 214, the first idle station 220, the bending station 224, the second idle station 226 and the notch station 228.

The present invention relates to an apparatus for bending of an elongate strip having opposed ends and a length between the opposed ends defining an axis of the strip to produce an arcuate shape along the length and made of a deformable material which comprises: a pair of spaced apart bending members which are moved together to bend the strip and then are moved apart, a first one of the bending members having an arcuate surface for bending the strip to form a bend in the strip when the bending members are moved together; and a second one of the bending members comprising at least two tool members mounted along the axis defined by the strip when the bending members are apart and wherein each of the tool members has holders which mount the strip, wherein at least one of the holders is pivotable and biased towards the arcuate surface and also rotates around the axis of the strip prior to or during bending, wherein the bending members rotate the strip on the one of the holders which is pivotable and deform the strip as the bending members are moved together and wherein the bending members are adapted to be mounted in a driving means for movement of the bending members.

Further, the present invention relates to an apparatus for bending of an elongate strip having opposed ends and a length between the opposed ends defining an axis of the strip to produce an arcuate shape along the length and made of a deformable material which comprises: a pair of spaced apart bending members which are moved together to bend the strip and then are moved apart, a first one of the bending members having an arcuate surface for bending the strip to form a bend in the strip when the bending members are moved together; and a second one of the bending members comprising at least three tool members with two of the tool members positioned on opposed sides of the third tool member and mounted along the axis defined by the strip when the bending members are apart, wherein the third tool member is biased by a spring means towards the arcuate surface, wherein each of the tool members has holders which mount the strip wherein at least one of the holders is pivotable and biased towards the arcuate surface by a spring means which also rotates around the axis of the strip prior to or during the bending, wherein the bending members rotate the strip on the one of the holders which is pivotable and deform the strip as the bending members are moved together and wherein the bending members are adapted to be mounted in a driving means for movement of the bending members.

Still further, the present invention relates to a method for bending of an elongate strip having opposed ends and a length between the opposed ends defining an axis of the strip to produce an arcuate shape along the length of a deformable material which comprises: providing in a driving means a pair of spaced apart bending members which are moved together to bend the strip and then are moved apart, a first one of the bending members having an arcuate surface for bending the strip to form a bend in the strip when the bending members are moved together; and a second one of the bending members comprising at least two tool members mounted along the axis defined by the strip when the bending members are apart and wherein each of the tool members has holders which mount the strip, wherein at least one of the holders is pivotable and biased towards the arcuate surface and also rotates around the axis of the strip prior to or during bending, wherein the bending members rotate the strip on the one of the holders which is pivotable and deform the strip as the bending members are moved together; providing the strip between the bending members mounted on the holders; and moving the bending members together to bend the strip, wherein the arcuate surface has a bend which is greater than the arcuate shape to be produced in the strip; and moving the bending members apart, wherein the strip straightens to a curve which is less than the arcuate shape.

Furthermore, the present invention relates to a method for bending of an elongate strip having opposed ends and a length between the opposed ends defining an axis of the strip to produce an arcuate shape along the length of a deformable material which comprises: providing in a driving means a pair of spaced apart bending members which are moved together to bend the strip and then are moved apart, a first one of the bending members having an arcuate surface for bending the strip to form a bend in the strip when the bending members are moved together; and a second one of the bending members comprising at least three tool members with two of the tool members positioned on opposed sides of the third tool member and mounted along the axis defined by the strip when the bending members are apart, wherein the third tool member is biased by a spring means towards the arcuate surface, wherein each of the tool members has holders which mount the strip wherein at least one of the holders is pivotable and biased towards the arcuate surface by a spring means and also rotates around the axis of the strip prior to or during bending, wherein the bending members rotate the strip on the one of the holders which is pivotable and deform the strip as the bending members are moved together; providing the strip between the bending members mounted on the holders; and moving the bending members together to bend the strip, wherein the arcuate surface has a bend which is greater than the arcuate shape to be produced in the strip; and moving the bending members apart, wherein the strip straightens to a curve which is less than the arcuate shape.

Finally, the present invention relates to a replaceable tool member for bending an elongate strip, having opposed ends and a length between the opposed ends and a channel along the length of a deformable material, between first and second bending members which move together to accomplish the bending which comprises: a body adapted to be mounted on a bending apparatus; a pivotable holder means mounted on the body with a finger adapted to project into the channel of the strip, wherein the holder rotates on the body prior to or during the bending.

The bending apparatus unexpectedly enables the window channel for a vehicle to be provided with a compound bend along two different planes without damaging the decorative outer finish of the window channel. The convexity of the arcuate surface of the first one of the bending members can be changed by adjusting the length of adjustable means attached to a side opposite the arcuate surface used for bending. The arcuate surface is constructed from a flexible, deformable sheet in order to allow for change in the convexity of the surface.

Figure 4:
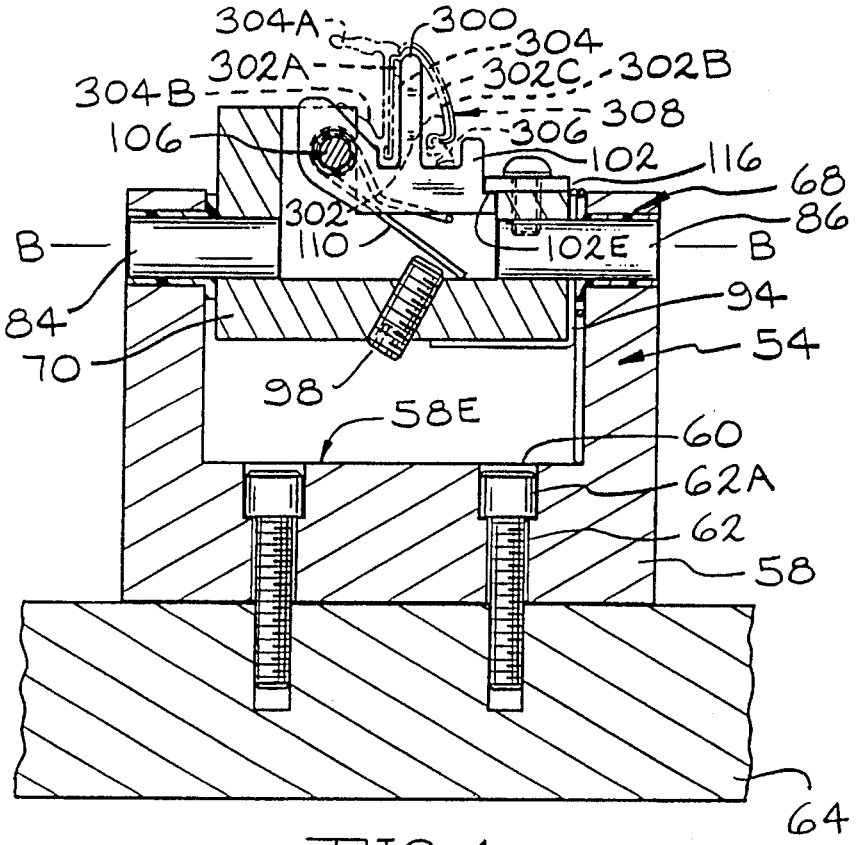
FIG. 4 is a side cross-sectional view of the first outer tool member 54 of FIG. 6 along the line 44 showing the housing 58 with the pivotable member 70 and the holder 102 in the upright position.
Figure 5:
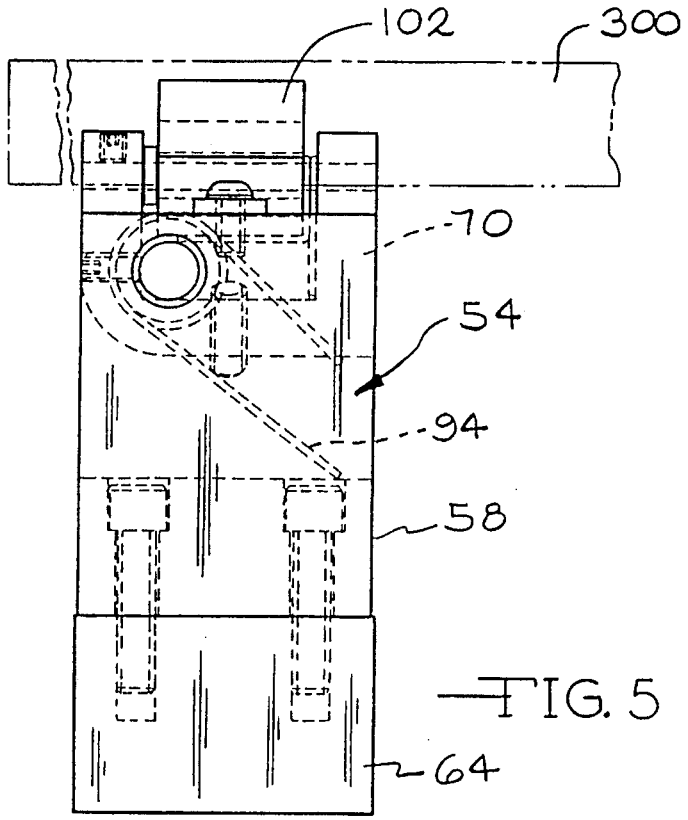
FIG. 5 is a front view of the first outer tool member 54, as shown in FIG. 4, showing the large coil return spring 94 and the molding 300 in the holder 102.
Figure 10:
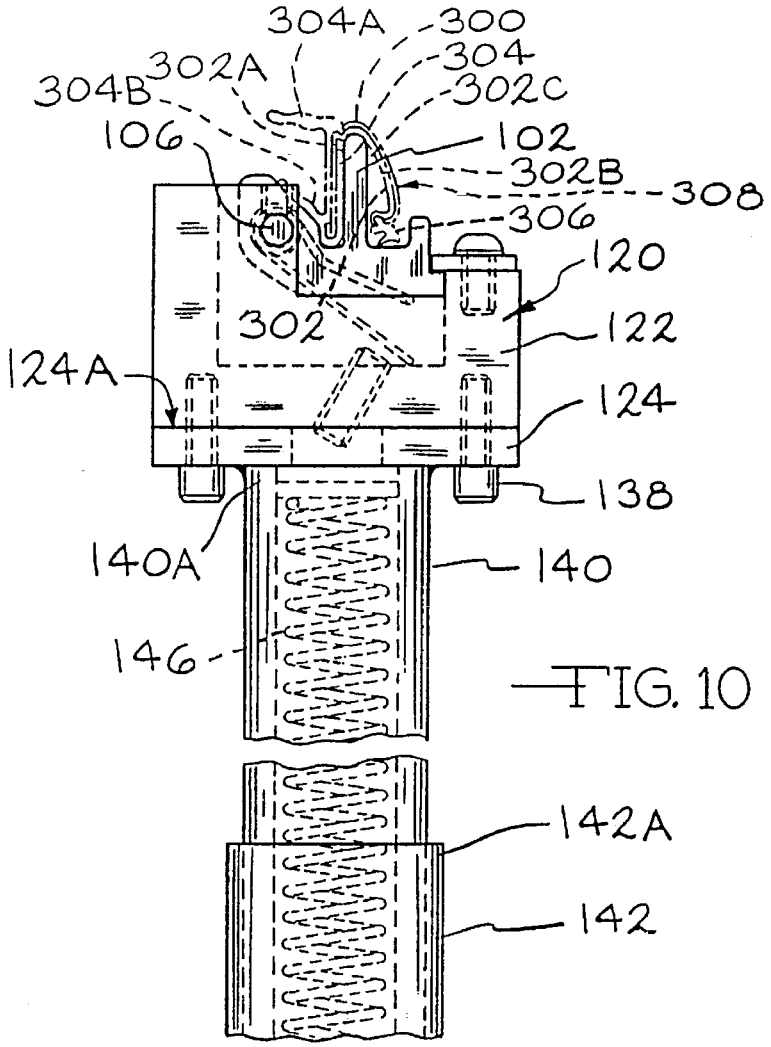
FIG. 10 is a side view of the middle tool member 120 showing the hollow shaft 140, the compression spring 146, the hollow tube 142 and the fixed member 122 of the middle tool member 120 mounted to the mounting plate 124.
Figure 7:
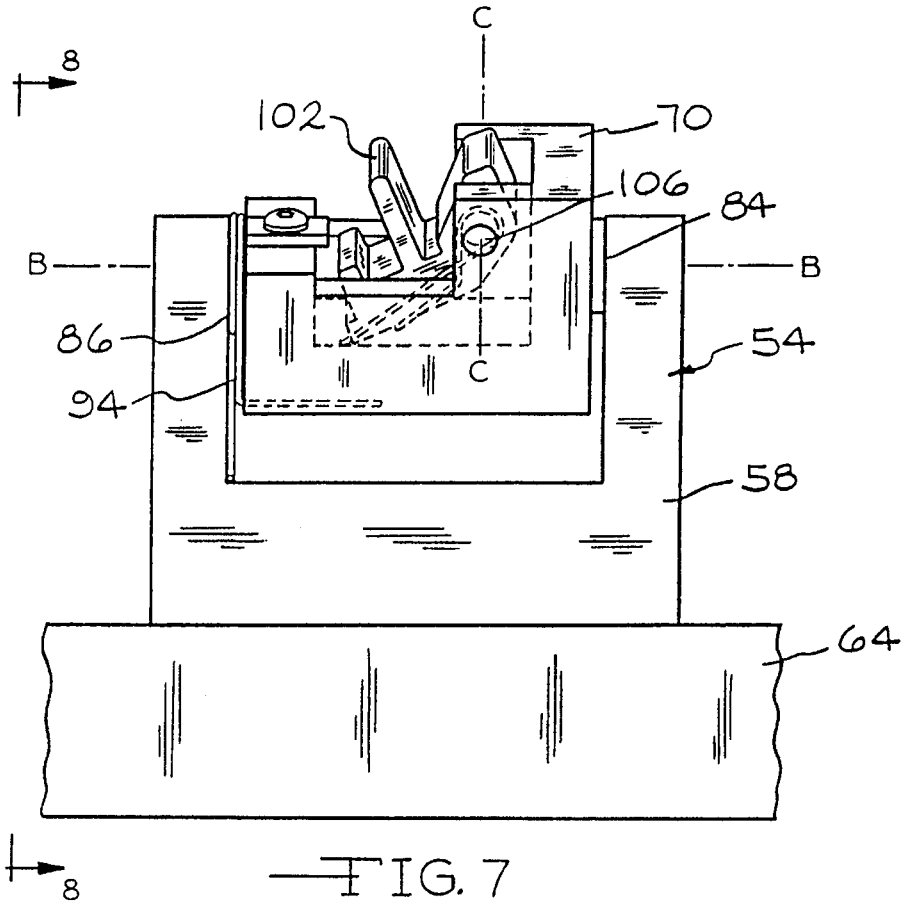
FIG. 7 is a side view of the first outer tool member 54, as shown in FIG. 4, showing the pivotable member 70 pivoted about the first pivot axis B—B and the holder 102 pivoted about the second pivot axis C—C.

The molding 300 formed in the bending apparatus 10 of the present invention is a window channel used to seal around the window of a vehicle (not shown). As shown in FIG. 4, the molding 300 is preferably a weatherstrip with an elongate core substrate 302 having a sealing member 304 and a decorative outer surface 308 attached thereto (FIGS. 4 and 10). The elongate core substrate 302 is U-shaped with a first leg 302A and a second leg 302B forming a channel 302C. The substrate 302 is preferably comprised of a lightweight, pliable metal such as aluminum. The sealing member 304 is attached to the first leg 302A of the channel 302C and wraps around the first leg 302A to extend into the channel 302C. The sealing member 304 has an upper and lower sealing lip 304A and 304B extending outward from the top and the bottom, respectively, of the substrate 302. Preferably, the upper sealing lip 304A extends outward perpendicular to the first leg 302A of the substrate 302 and the lower sealing lip 304B extends outward from the first leg 302A at an upward angle. The decorative outer surface 308 of the molding 300 is attached to the second leg 302B of the substrate 302 and extends the entire length of the second leg 302B of the substrate 302. The decorative outer surface 308 is preferably made from a thin sheet of pliable metal, preferably aluminum. An additional seal 306 mounted adjacent one end of the decorative outer surface 308 and the sealing member 304 on the other end of the decorative outer surface 308 helps to hold the decorative outer surface 308 in place on the second leg 302B. The decorative outer surface 308 has a colored metallic finish which is very easily scratched and also easily dented due to the thinness of the pliable metal.

Figure 2:
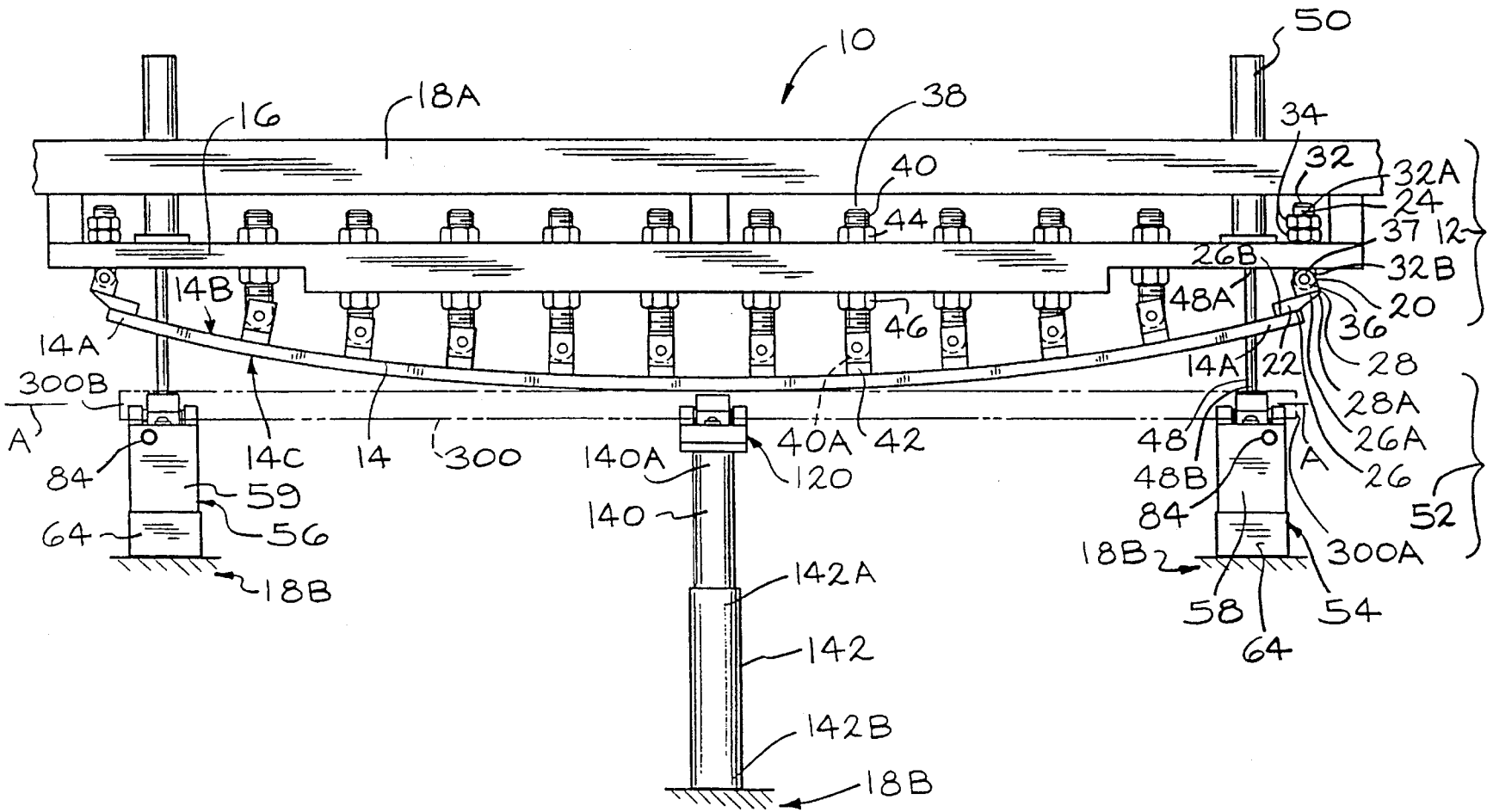
FIG. 2 is a front view of the upper and lower bending members 12 and 52 showing the bending surface 14, the adjustment units 38, the first and second outer tool members 54 and 56 and the middle tool member 120.
Figure 3:
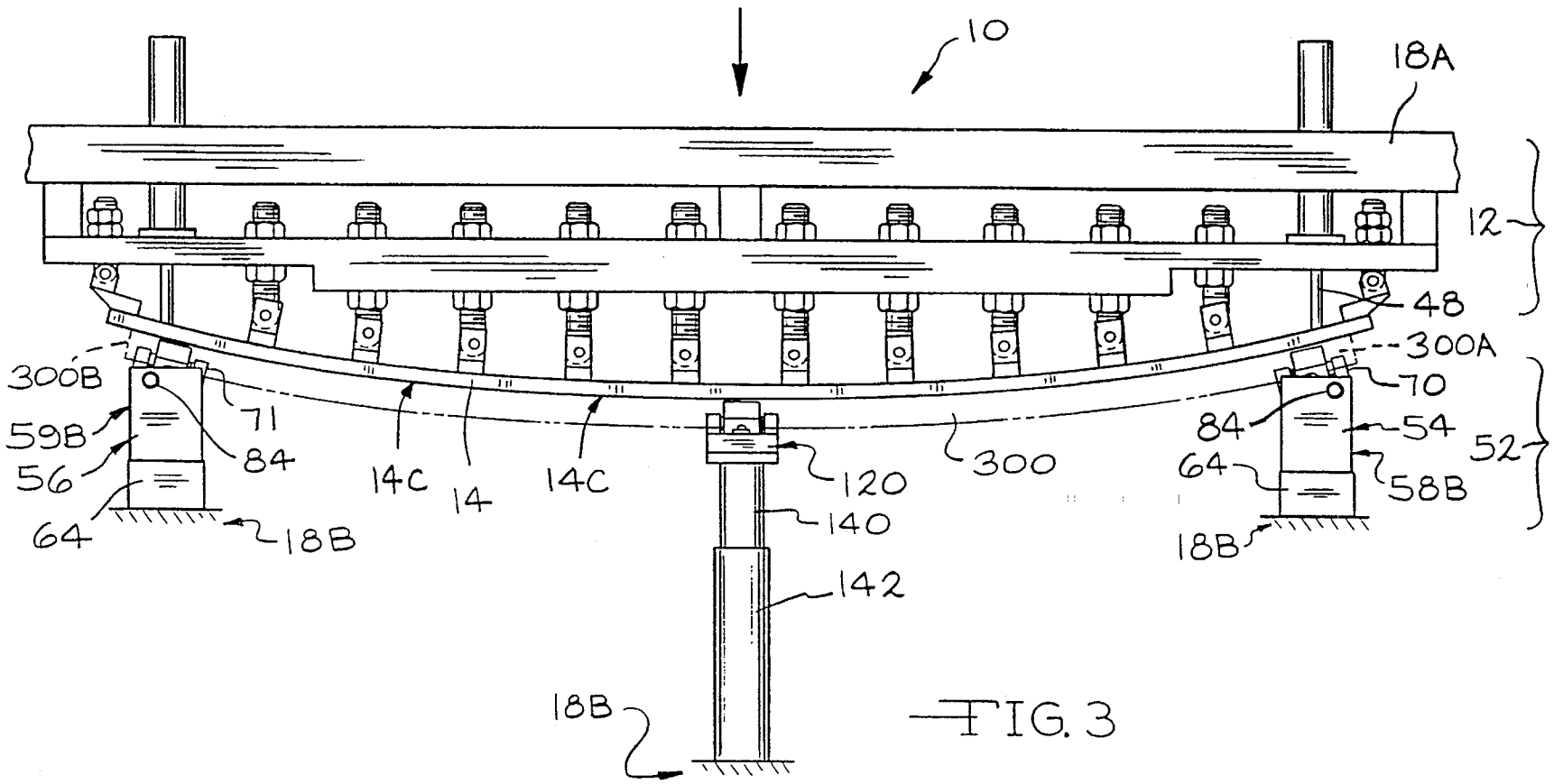
FIG. 3 is a front view of the bending apparatus 10 in the fully pressed position showing the pivot members 70 and 71 of the first and second outer tool members 54 and 56 in the pivoted position and showing the middle tool member 120 in the fully compressed position.

In the preferred embodiment, the bending and trimming system 200 processes the right and left hand moldings 300 and 301, simultaneously (FIG. 1A). The moldings 300 and 301 are provided in long strips having opposed ends 300A and 300B and 301A (only one end of molding 301 is shown), respectively (FIGS. 2 and 3). The length of the moldings 300 and 301 are approximately similar and are such as to span the distance between the two outer tool members 54 and 56 of the bending apparatus 10 (to be described in detail hereinafter). Initially, the moldings 300 and 301 are identical, however, after completing the bending and trimming process, the moldings 300 and 301 have equal but opposite bends. It is understood that the other moldings having a variety of sizes, shapes and surfaces may be used in the bending apparatus. In addition, these moldings have other uses in the automotive industry and may also be used in other industries such as the aircraft industry.

Figure 1B:
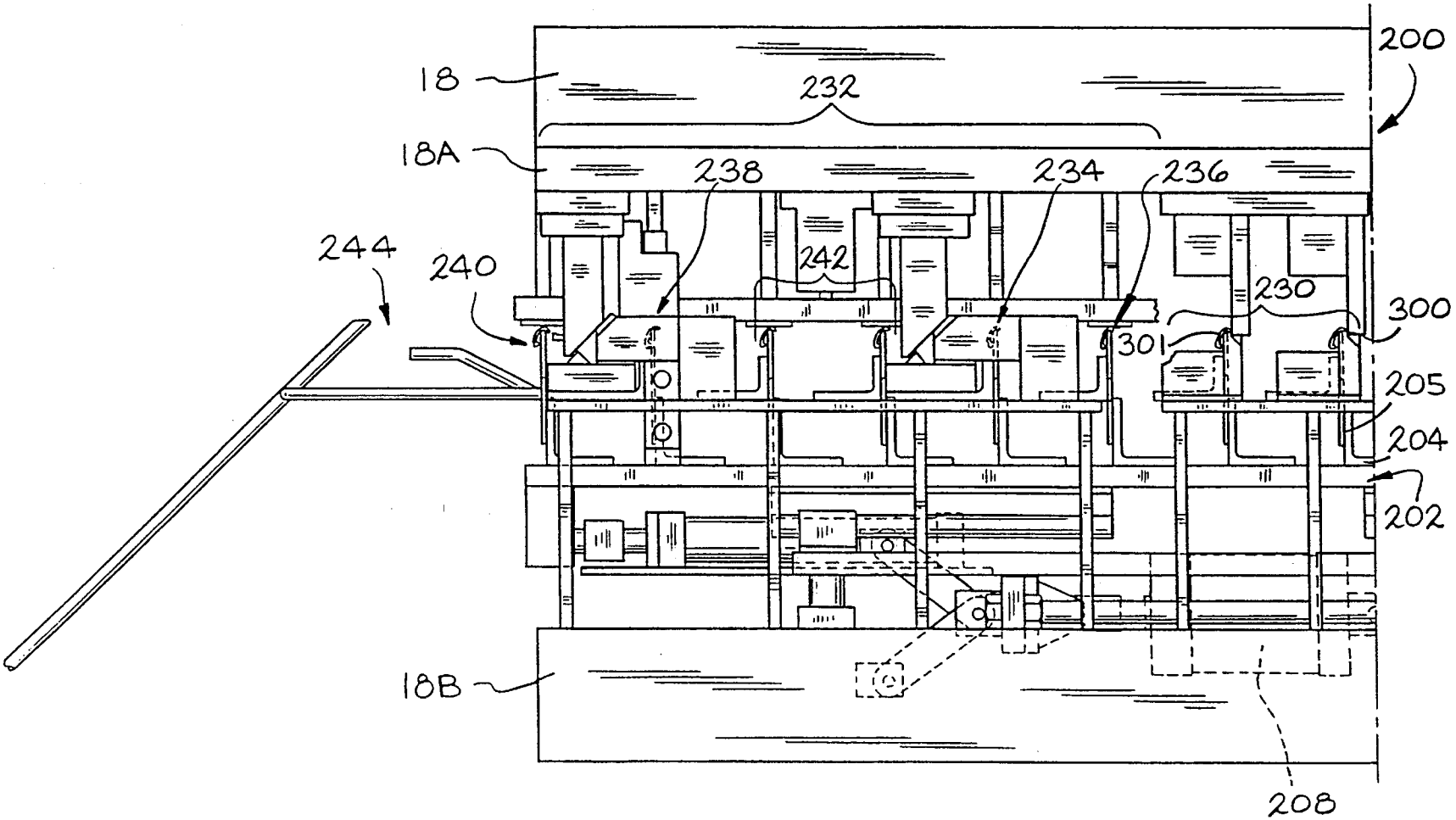
FIG. 1B is a side view of the second half of the bending and trimming system 200 showing the trimming station 230, the cut off station 232 including the left hand cut off 234, the single right hand idle 236, the right hand cut off 238, the single left hand idle 240, the complete idle station 242 and the unload station 244.

FIGS. 2 to 11 and 16 to 18 show the bending apparatus 10 of the present invention. The bending apparatus 10 (FIG. 1A) represents a portion of a bending station 224 of a bending and trimming system 200 (FIGS. 1A and 1B). The bending apparatus 10 includes an upper bending member 12 and a lower bending member 52. The upper bending member 12 is comprised of a bending surface 14 having opposed ends 14A with a top side 14B and an opposed bottom side 14C defining the surface 14. The top side 14B of the bending surface 14 is pivotably mounted at the opposed ends 14A to a support bar 16 which is mounted to a press 18 having a top moving portion 18A and a bottom fixed portion 18B. The top moving portion 18A of the press 18 provides the driving power to the upper bending member 12 (FIG. 1A). Preferably, the support bar 16 is longer than the bending surface 14 and is parallel to the axis A—A of the unbent molding 300 prior to bending in the bending apparatus 10. The bending surface 14 is mounted onto the support bar 16 by an identical pivotable fastener 20 at each end 14A. The pivotable fastener 20 is comprised of a lower portion 22 and an upper portion 24. The lower portion 22 has an extension plate 26 with a first yoke 28 mounted at one end 26A. The first yoke 28 has two parallel legs 28A (one shown) extending parallel to the axis A—A of the molding 300 prior to bending in the bending apparatus 10 with a hole (not shown) extending through each leg 28A perpendicular to the axis A—A. The other end 26B of the extension plate 26 is mounted onto the end 14A of the bending surface 14 such that the first yoke 28 of the lower portion 22 extends outward from the end 14A of the bending surface 14 parallel to the axis A—A of the unbent molding 300 mounted in the bending apparatus 10. The upper portion 24 of the pivotable fastener 20 includes a first threaded rod 32 having a proximal end 32A and a distal end 32B. The first threaded rod 32 is mounted through an opening (not shown) in the support bar 16 above the first yoke 28 of the lower portion 22 of the pivotable fastener 20. The first threaded rod 32 is mounted through the opening such that the proximal end 32A extends above the support bar 16 and the distal end 32B extends below the support bar 16 and between the legs 28A of the first yoke 28. The first threaded rod 32 is secured within the opening of the support bar 16 by two nuts 34 secured onto the proximal end 32A of the first threaded rod 32 adjacent the support bar 16. The distal end 32B of the first threaded rod 32 is provided with an eye (not shown) extending perpendicular to the axis A—A which is aligned with the hole in the legs 28A of the first yoke 28 when the lower portion 22 and the upper portion 24 are placed together. The upper and lower portions 22 and 24 of the pivotable fastener 20 are secured together by a nut 36 and bolt 37 extending through the hole of the first yoke 28 and the eye of the first threaded rod 32. The diameter of the bolt 37 is preferably slightly less than the diameter of the eye of the first threaded rod 32 such that the first threaded rod 32 is able to rotate easily about the bolt 37. The pivotable fastener 20 enables the bending surface 14 to pivot at the opposed ends 14A which allows the curvature of the bending surface 14 to be varied.

The bending surface 14 is also attached to the support bar 16 by a plurality of adjustment units 38 spaced along the top side 14B of the bending surface 14 between the opposed ends 14A of the bending surface 14. Each adjustment unit 38 is identical and contains a second threaded rod 40 mounted through the support bar 16 and a second yoke 42 mounted on the top side 14B of the bending surface 14. The second yoke 42 and second threaded rod 40 of the adjustment unit 38 are preferably similar to the first yoke 28 and first threaded rod 32, respectively, of the pivotable fastener 20. The adjustment units 38 allow the bending surface 14 to pivot along its length thus allowing a smooth bending of the bending surface 14. The second threaded rod 40 is mounted through an opening (not shown) in the support bar 16 such that the distal end 40A of the second threaded rod 40 is adjacent the second yoke 42 on the top side 14B of the bending surface 14. The distal end 40A of the second threaded rod 40 and the second yoke 42 of the adjustment unit 38 are attached together similarly to the distal end 32B of the first threaded rod 32 and the first yoke 28 of the pivotable fastener 20. Unlike the first yoke 28 of the pivotable fastener 20, however, the second yoke 42 of the adjustment unit 38 is mounted directly onto the top side 14B of the bending surface 14. The second yoke 42 is mounted onto the top side 14B of the bending surface 14 by bolts (not shown) which extend upward through the bending surface 14 and into holes (not shown) on either side of the second yoke 42. The heads (not shown) of the bolts are preferably adjacent the bottom side 14C of the bending surface 14 but are sunken such that the heads of the bolts do not extend beyond the bottom side 14C of the bending surface 14 and thus do not contact the molding 300 during bending. The bottom side 14C of the bending surface 14 is preferably smooth such that any contact with the decorative outer surface 308 of the molding 300 does not damage the decorative outer surface 308. The second threaded rod 40 of the adjustment unit 38 is secured in the opening in the bending surface 14 by a first and second nut 44 and 46 mounted onto the second threaded rod 40 above and below the support bar 16, respectively. The nuts 44 and 46 allow the length of second threaded rod 40 extending below the support bar 16 to be adjusted. By changing the length of the second threaded rods 40 of the adjustment units 38 along the length of the bending surface 14, the curvature of the bending surface 14 is able to be changed. Changing the curvature of the bending surface 14 changes the resulting bend in the molding 300. Thus, the adjustment units 38 enable the bending apparatus 10 to be used to bend the molding 300 with a variety of different curvatures. In the preferred embodiment, there are ten (10) adjustment units 38 along the length of the bending surface 14. The number of adjustment units 38 along the length of the bending surface 14 determines the complexity of curvature possible in the bending surface 14 and the accuracy of the curvature in the bending surface 14. The bending surface 14 is preferably constructed of a flexible, deformable material, preferably a nylon, such that varying the length of the adjustment units 38 smoothly changes the curvature of the bottom side 14C of the upper bending member 12. The bending surface 14 is preferably at least as wide as the molding 300 so as to contact as much of the molding 300 as possible during bending.

A retractable post 48 having a proximal end 48A and a distal end 48B is located at each end 14A of the bending surface 14. The retractable post 48 is mounted such that the distal end 48B of the retractable post 48 extends downward through an opening (not shown) in the end 14A of the bending surface 14 adjacent the pivotable fastener 20. Preferably, the opening is located in each end 14A of the bending surface 14 between the pivotable fastener 20 and the adjacent adjustment unit 38. The proximal end 48A of the retractable post 48 extends upward through an opening (not shown) in the support bar 16 into a retraction cylinder 50. A coil spring (not shown) is provided in the retraction cylinder 50 above the proximal end 48A of the retractable post 48. Preferably, the openings in the support bar 16 and the bending surface 14 are of a size such that the retractable post 48 is able to be easily moved upward through the openings into the retraction cylinder 50. The proximal end 48A of the retractable post 48 contains a stopper (not shown) which prevents the retractable post 48 from falling through the opening in the support bar 16. When the upper bending member 12 is spaced above the lower bending member 52, the retractable posts 48 of the upper bending member 12 are in the fully extended position due to gravity and the coil spring in the retraction cylinder 50. As seen in FIG. 2, when the lowest portion of the bending surface 14 of the upper bending member 12 is adjacent and barely touching the molding 300, the distal end 48B of the retractable post 48 is adjacent or marginally in contact with the upper sealing lip 304A of the sealing member 304 of the molding 300. As the upper bending member 12 is moved downward toward the lower bending member 52, the distal end 48B of the retractable post 48 fully contacts the upper sealing lip 304A of the sealing member 304 of the molding 300. As the retractable post 48 contacts the molding 300, the retractable post 48 acts to pivot the molding 300 and thus the holder 102 of the outer tool members 54 and 56 (to be discussed in detail hereinafter). The coil spring in the retraction cylinder 50 tends to bias the distal end 48B of the retractable post 48 toward the molding 300. The coil spring provides a downward force on the retractable post 48 which enables the retractable post 48 to have sufficient downward force to pivot the molding 300 and the holder 102. In the preferred embodiment, the coil spring in the retractable cylinder 50 is only slightly stronger than the small coil return spring 110 of the holder 102 in order to enable the retractable post 48 to pivot the holder 102. As the upper bending member 12 continues to move downward, the retractable post 48 retracts upward keeping constant contact with the sealing member 304 of the molding 300 so as to keep the molding 300 and the holder 102 in the pivoted position. When the bottom side 14C of the bending surface 14 makes contact with the molding 300 in the holder 102 of the outer tool members 54 and 56, the retractable post 48 is fully retracted. The distal end 48B of the retractable post 48 however remains in contact with the molding 300 even though it is no longer being used to pivot the molding 300 and the holders 102. At this point, the bottom side 14C of the bending surface 14 acts to hold the molding 300 and the holder 102 in the pivoted position (FIG. 3). Preferably, the distal end 48B of the retractable post 48 is flush with the bottom side 14C of the bending surface 14 when the retractable post 48 is in the fully retracted position. In the preferred embodiment, the bending surface 14 has a convex curvature such that the opposed ends 14A of the bending surface 14 extend upward such that the lowest point of the bending surface 14 is at the center of the bending surface 14 over the middle tool member 120 (to be discussed in detail hereinafter). Thus, the retractable posts 48 are necessary in order to pivot the molding 300 continuously and simultaneously along its length. The retractable posts 48 prevents excess pressure on the molding 300 in the holder 102 of the middle tool member 120 which could potentially crush the channel 302C of the molding 300.

The lower bending member 52 is mounted on the bottom fixed portion 18B of the press 18 below the upper bending member 12 and includes spaced apart first and second outer tool members 54 and 56 with a middle tool member 120 therebetween. The two outer tool members 54 and 56 are preferably located directly below the retractable posts 48 at either end 14A of the bending surface 14. The middle tool member 120 is preferably located below the center of the bending surface 14 such that in the preferred embodiment, five adjustment units 38 are located on either side of the middle tool member 120 (FIG. 2).

The first and second outer tool members 54 and 56 are located on the right and left side of the bending station 224, respectively (to be described in detail hereinafter) and are shown in detail in FIGS. 4 to 9. The first and second outer tool members 54 and 56 are mirror images of each other and are therefore identical except for the placement of the front and back pivot pins 84 and 86 which mount pivotable members 70 and 71 in the housings 58 and 59 and a large coil return spring 94 (one shown) which returns the pivotable members 70 and 71 to the upright position (to be discussed in detail hereinafter). FIG. 10 shows the first outer tool member 54 located on the right side and the positioning of the front and back pivot pins 84 and 86. The second outer tool member 56 is located on the left side and has the pivot pins 84 (one shown) (FIG. 3) mounted on the opposite side of the housing 59 (FIG. 3). The pivotable members 70 and 71 of the first and second outer tool members 54 and 56 are mounted within the housings 58 and 59 such that the pivotable members 70 and 71 of both outer tool members 54 and 56 pivot inward toward the middle tool member 120. The pivotable members 70 and 71 of the two outer tool members 54 and 56 are both mounted toward the outer side 58B and 59B of the housings 58 and 59 to prevent the pivotable members 70 and 71 from making contact with the bottom 58E (one shown) of the housings 58 and 59 when the pivotable members 70 and 71 pivots inward. The positioning of the large coil return spring 94 is also opposite for both of the first and second outer tooling members 54 and 56 in order to return the pivotable members 70 and 71 to the upright position once the pressure of the upper bending member 12 is removed from the molding 300 and the tool members 54 and 56. Due to the similarity of the first and second outer tool members 54 and 56, only the first outer tool member 54 on the right side of the bending apparatus 10 will be described in detail.

Figure 9:
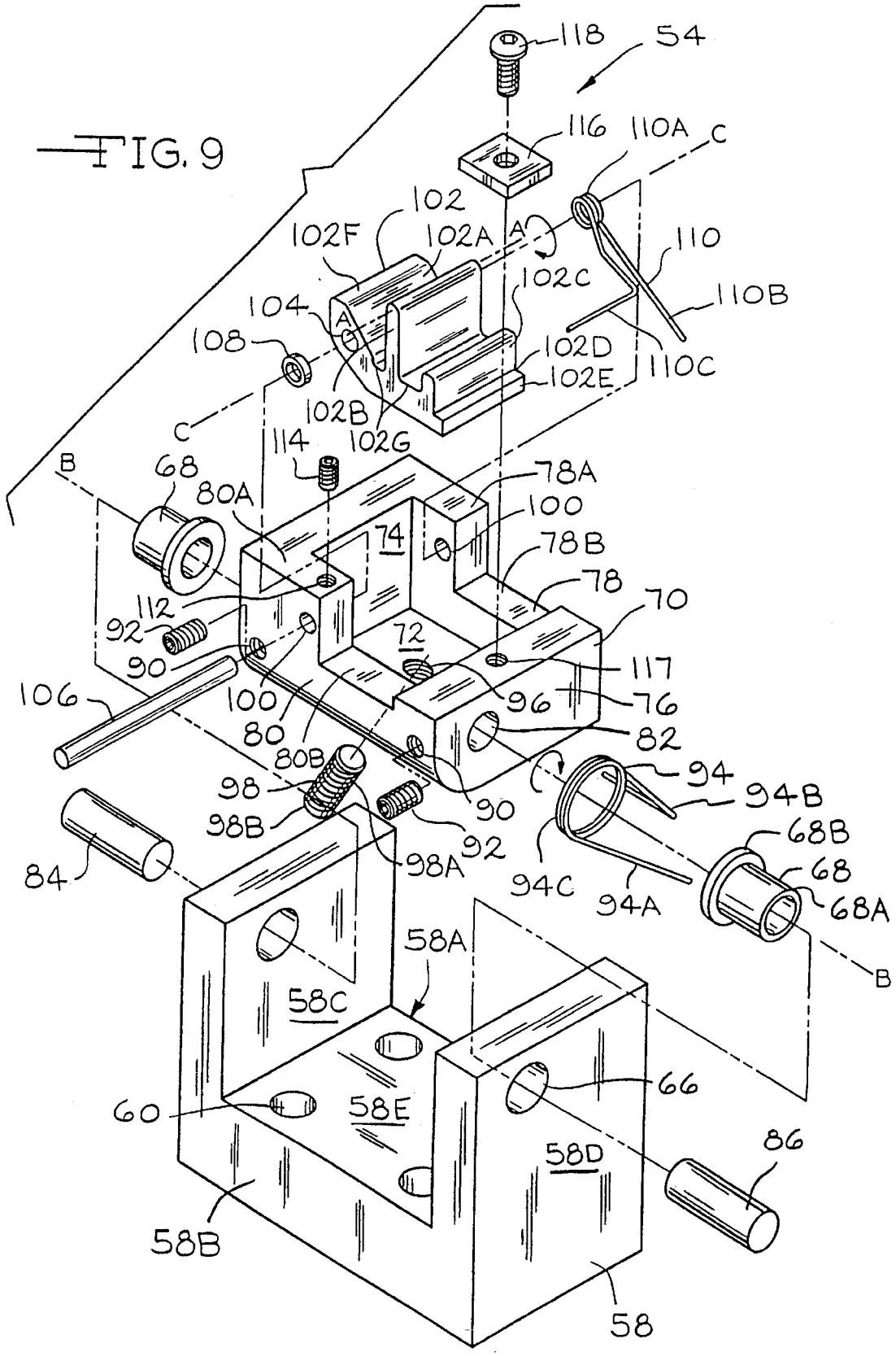
FIG. 9 is an exploded perspective view of the first outer tool member 54 showing the fixed housing 58, the front and back pivot pins 84 and 86, the bushings 68, the pivotable member 70, the large coil return spring 94, the first and second set screws 92 and 114, the threaded stopper 98, the holder 102 with the center finger 102B, the pivot rod 106, the small coil return spring 110, the spacer 108 and the stopper plate with the bolt 118.

As shown in FIG. 10, the first outer tool member 54 of the right side includes a housing 58 within which is mounted a pivotable member 70 which mounts a holder 102. The housing 58 has an inner side 58A and an outer side 58B with a front leg 58C, a back leg 58D and a bottom 58E, spaced therebetween. Preferably, the housing 58 has a square U-shape. The bottom 58E of the housing 58 contains four holes 60 through which are mounted four bolts 62 (two shown) (FIGS. 4 and 9). The four bolts 62 extend through the bottom 58E of the housing 58 and into a side mounting bar 64 which is part of the bending and trimming system 200. Preferably, the bolts 62 extend through the bottom 58E of the housing 58 and into the side mounting bar 64 of the bottom fixed portion 18B of the press 18 of the bending and trimming system 200 such that the head 62A of the bolt 62 is recessed within the bottom 58E of the housing 58 (FIG. 4). The housing 58 is mounted onto the lower fixed portion 18B of the press 18 at the bending station 224 (FIG. 1A) such that the legs 58C and 58D of the housing 58 are parallel to the axis A—A of the molding 300 prior to bending in the bending apparatus 10 with the front leg 58C adjacent the first idle station 220 (to be described in detail hereafter) of the bending and trimming system 200. When mounted on the bending station 224, the inner side 58A of the housing 58 is toward the middle outer tool member 120. Each leg 58C and 58D of the housing 58 is provided with an identical coaxial aperture 66. The aperture 66 extends perpendicular to the axis A—A of the molding 300 prior to bending in the bending apparatus 10 and is located opposite the bottom 58E of the housing 58 adjacent the outer side 58B of the housing 58. Preferably, the housing 58 is constructed from a single unitary piece and is constructed of a tough metal such as steel.

A bushing 68 is provided in each aperture 66 of the housing 58. The bushing 68 has a cylindrical portion 68A with a cap 68B at one end. The bushing 68 is mounted within the aperture 66 of the housing 58 such that the cylindrical portion 68A extends into the aperture 66 and the cap 68B is adjacent the leg 58C or 58D of the housing 58 between the pivotable member 70 and the leg 58C and 58D of the housing 58. Preferably, the cylindrical portion 68A of the bushing 68 has an outer diameter similar to the diameter of the aperture 66 of the housing 58 such that there is no appreciatable side-to-side movement of the bushing 68 within the aperture 66. The inner diameter of the bushing 68 is preferably slightly larger than the outer diameter of the pivot pins 84 and 86 (to be discussed in detail hereinafter) such that the pivot pins 84 and 86 are able to rotate freely within the bushings 68.

The pivotable member 70 is pivotably mounted between the legs 58C and 58D of the housing 58. The pivotable member 70 has a bottom wall 72 with a front wall 74 and a back wall 76 having an inside wall 78 and an outside wall 80 extending therebetween. In the preferred embodiment, the pivotable member 70 is formed as a single unitary piece and is preferably constructed from a metal such as steel. The pivotable member 70 is mounted within the housing 58 such that the front and back walls 74 and 76 extend parallel to the axis A—A of the molding 300 prior to bending in the bending apparatus 10 and are adjacent and parallel to the front and back legs 58C and 58D, respectively, of the housing 58. The front wall 74 of the pivotable member 70 is preferably rectangular in shape and has approximately the same width as the legs 58C and 58D of the housing 58. Thus, when mounted between the legs 58C and 58D of the housing 58 in the straight up position, the pivotable member 70 does not extend beyond the inner side 58A or the outer side 58B of the housing 58. The back wall 76 is preferably similar in shape to the front wall 74 but is approximately only half the height of the front wall 74. The height of the back wall 76 is such that the top of the back wall 76 is flush with the top of the back leg 58D of the housing when the pivotable member 70 is mounted within the housing 58 in the unpivoted position. The front wall 74 and back wall 76 of the pivotable member 70 are each provided with a first hole 82 adjacent the outside wall 80 which extends perpendicular to the axis A—A of the molding 300 prior to bending in the bending apparatus 10 (FIG. 9). The first holes 82 are preferably of identical shape and size and are also coaxial. The first holes 82 are located such that when the pivotable member 70 is mounted between the legs 58C and 58D of the housing 58, the first holes 82 of the pivotable member 70 are aligned with the apertures 66 of the housing 58. When correctly mounted, the front wall 74 of the pivotable member 70 is adjacent the front leg 58C of the housing 58 and the back wall 76 of the pivotable member 70 is adjacent the back leg 58D of the housing 58.

Figure 8:
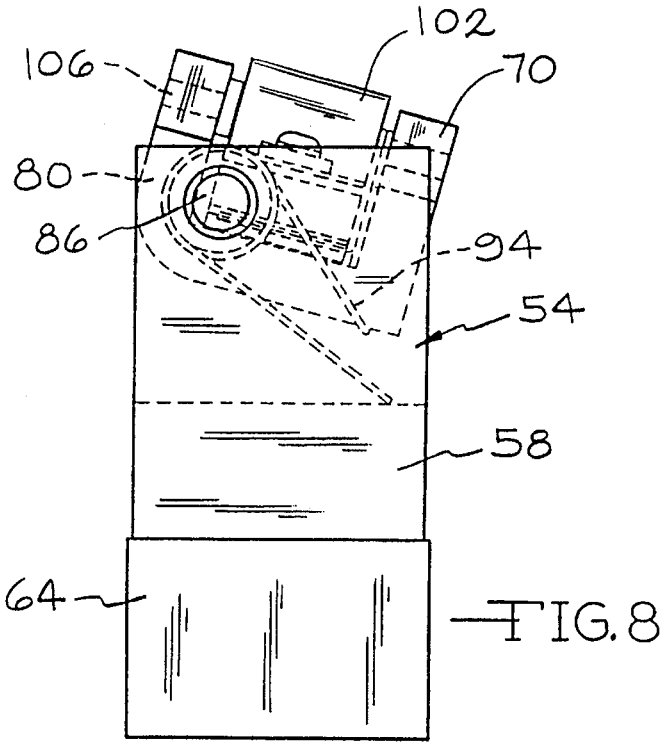
FIG. 8 is a rear view of FIG. 7 along the line 8—8 showing the large coil return spring 94 and the rounded bottom edge of the outside wall 80 of the pivotable member 70.

The pivotable member 70 is mounted within the housing 58 by front and back pivot pins 84 and 86 which extend through the apertures 66 of the housing 58 and into the first holes 82 of the pivotable member 70. The front pivot pin 84 extends through the front leg 58C of the housing 58 and into the first hole 82 of the front wall 74 of the pivotable member 70. The back pivot pin 86 extends through the back leg 58D of the housing 58 and into the first hole 82 in the back wall 76 of the pivotable member 70. The pivot pins 84 and 86 enable the pivotable member 70 to pivot about the first pivot axis B—B (FIG. 8). The pivot pins 84 and 86 are preferably of a length such as to extend through the legs 58C and 58D of the housing 58 and through the front or back wall 74 or 76, respectively, of the pivotable member 70. Preferably, when fully in place, one end of the pivot pin 84 or 86 extends outward beyond the leg 58C or 58D of the housing 58 while the other end of the pivot pin 84 or 86 remains within the wall 74 or 76 of the pivotable member 70. The pivot pins. 84 and 86 are at least of a length so as to extend completely through the leg 58C or 58D and through the wall 74 or 76, respectively. Preferably, the outer diameter of the pivot pin 84 or 86 is slightly less than the inner diameter of the bushing 68 mounted in the aperture 66 and the diameter of the first hole 82, such that the pivot pins 84 and 86 are able to rotate easily within the bushings 68 in the apertures 66 in the housing 58 to allow the pivotable member 70 to be pivoted in response to minimal pressure from the upper bending member 12. The outside surface of the pivot pins 84 and 86 is preferably smooth in order to prevent extraneously friction between the pivot pins 84 and 86 and the bushings 68 during pivoting of the pivotable member 70.

The inside wall 78 and outside wall 80 of the pivotable member 70 are preferably similar in shape except for the rounded bottom edge of the outside wall 80 (FIG. 10). The outside wall 80 of the pivotable member 70 is rounded adjacent the bottom wall 72 of the pivotable member 70 such that during pivoting of the pivotable member 70 within the housing 58, the outside wall 80 of the pivotable member 70 does not extend beyond the outer side 58B of the housing 58 (FIG. 9). Thus, there are no sharp corners exposed during the bending process which could potentially cause harm to the user. The inside and outside walls 78 and 80 have an enlarged portion 78A and 80A and a reduced portion 78B and 80B. The enlarged portion 78A and 80A of the inside and outside walls 78 and 80 is adjacent the front leg 58C of the housing 58 and is preferably similar in height to the front wall 74 of the pivotable member 70. The enlarged portion 78A and 80A preferably extends from the front wall 74 toward the back wall 76 less than half the distance between the front and back wall 76 of the pivotable member 70. The reduced portion 78B and 80B extends from the enlarged portion 78A to the back wall 76. The reduced portion 78B and 80B of the inside and outside walls 78 and 80 preferably has a height slightly less than the height of the back wall 76.

Figure 6:
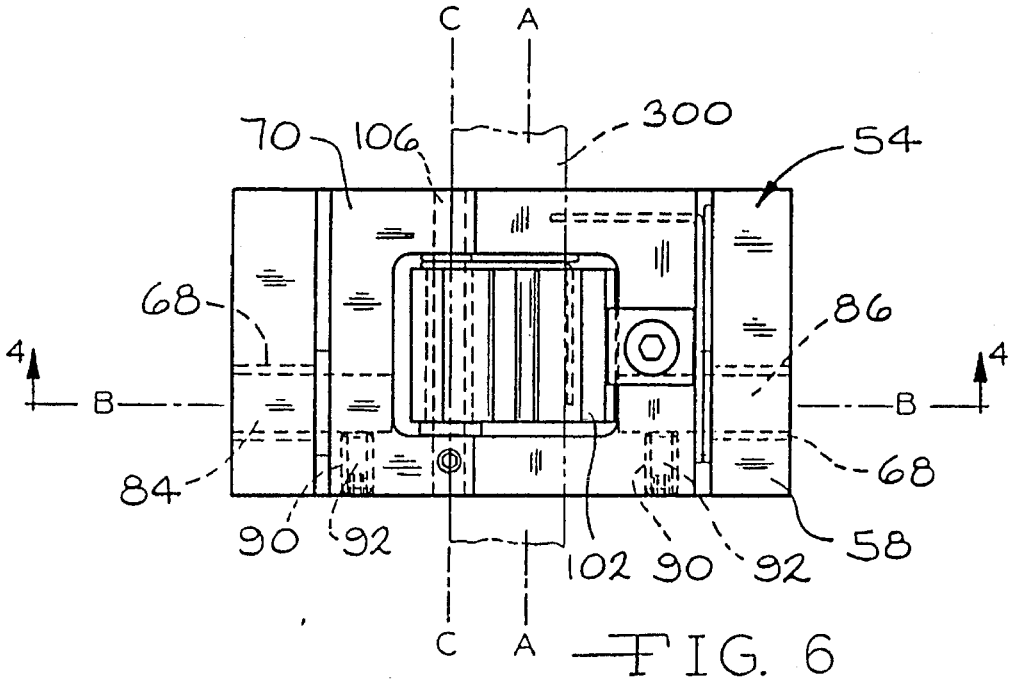
FIG. 6 is a top or plan view of the first outer tool member 54, as shown in FIG. 4, showing the axis A—A of the molding 300 prior to bending the bending apparatus 10, the first pivot axis B—B of the pivotable member 70 and the second pivot axis C—C of the holder 102.

The outside wall 80 of the pivotable member 70 is provided with a pair of first threaded apertures 90 one adjacent to each of the front wall 74 and the back wall 76 of the pivotable member 70 (FIG. 10). The first threaded apertures 90 extend parallel to the axis A—A of the molding 300 to be bent in the bending apparatus 10 through the outside wall 80 and through either the front wall 74 or the back wall 76 of the pivotable member 70, to intersect with the first holes 82 of the front and back wall 76, respectively. A pair of first set screws 92 are inserted into the pair of first threaded apertures 90. The first set screws 92 when fully inserted into the first threaded apertures 90, extend into the first holes 82 of the pivotable member 70 adjacent the front and back pivot pins 84 and 86 (FIG. 6). The first set screws 92 act to hold the pivot pins 84 and 86 motionless within the first holes 82 of the pivotable member 70 such that during bending the pivot pins 84 and 86 pivot with the pivotable member 70 within the apertures 66 of the housing 58.

A large coil return spring 94 having a long end 94A, a short L-shaped end 94B and a circular center 94C is mounted between the back wall 76 of the pivotable member 70 and the back leg 58D of the housing 58 or bushing 68. The large coil return spring 94 has a circular center 110A aligned with the aperture 66 of the housing 58 and the first hole 82 of the pivotable member 70 such that when the pivotable member 70 is mounted in the housing 58, the front pivot pin 84 extends through the circular center 94C of the large spring 94. The long end 94A of the large spring 94 extends at a downward angle from the center 94C toward the inside wall 78 of the pivotable member 70 and stops adjacent the bottom 58E of the housing 58. The short L-shaped end 94B of the large spring 94 extends downward at an angle from the center 94C toward the inside wall 78 of the pivotable member 70 and underneath the bottom wall 72 of the pivotable member 70. The large spring 94 acts to return the pivotable member 70 to the upright position once the downward pressure of the upper bending member 12 is removed.

The bottom wall 72 of the pivotable member 70 preferably has a square shape and is surrounded by the remaining four walls 74, 76, 78 and 80. The bottom wall 72 is provided with a second threaded aperture 96 extending through the bottom wall 72 at an angle essentially perpendicular the axis A—A of the molding 300 to be bent in the bending apparatus 10. A threaded stopper 98 having a proximal end 98A and a distal end 98B is provided in the angled second threaded aperture 96. The threaded stopper 98 is mounted in the angled second threaded aperture 96 such that the proximal end 98A extends above the bottom wall 72 of the pivotable member 70 and acts to limit the pivoting distance of the holder 102 (to be described in detail hereinafter) (FIG. 4). The distal end 98B of the stopper 98 extends below the bottom wall 72 of the pivotable member 70 and preferably has an internal hexagonal shaped head (not shown) such that a wrench is able to be used to adjust the stopper 98.

A second hole 100 is provided in the inside and outside walls 78 and 80 of the pivotable member 70. The second hole 100 is preferably located in the enlarged portion 78A and 80A of the inside and outside walls 78 and 80 adjacent the reduced portion 78B and 80B and extends completely through the inside and outside walls 78 and 80 parallel to the axis A—A of the molding 300 to be bent in the bending apparatus 10. The second holes 100 preferably have an identical shape and size and are coaxial.

A holder 102 for the molding 300 is mounted between the enlarged portions 78A and 80A of the inside and outside walls 78 and 80 of the pivotable member 70. The holder 102 is preferably shaped such as to accommodate the intricate bends of the molding 300 and to securely hold the molding 300 during bending. In the preferred embodiment as shown in FIG. 10, the holder 102 is provided with a sloped front 102A, a center finger 102B and a smaller back ridge 102C extending upward from the top surface 102D and a back edge 102E. The molding 300 is mounted on the top surface 102D of the holder 102 such that the decorative outer surface 308 of the molding 300 is between the finger 102B and the smaller back ridge 102C while the sealing member 304 attached to the first leg 302A of the core substrate 302 of the molding 300 extends outward toward the sloped front 102A of the holder 102. The slope of the sloped front 102A of the holder 102 preferably corresponds to the upward angle of the lower sealing lip 304B of the sealing member 304 with respect to the bottom of the core substrate 302. The top 102F of the sloped front 102A of the holder 102 is truncated such that the sloped front 102A of the holder 102 does not extend above the front wall 74 of the pivotable member 70 when the holder 102 is mounted in the pivotable member 70. The center finger 102B of the holder 102 extends into the channel 302C of the core substrate 302 of the molding 300 and is of a size such as to easily fit within the channel 302C of the molding 300. The center finger 102B of the holder 102 extends into the channel 302C such that when the molding 300 is securely on the holder 102, the top 102F of the finger 102B is adjacent the top 102F of the channel 302C (FIG. 4). Notches 102G are provided on the top surface 102D of the holder 102 on either side of the center finger 102B. Thus, there is a notch 102G between the bottom of the sloped front 102A and the center finger 102B and a notch 102G between the back ridge 102C and the center finger 102B. The notches 102G accommodate the bottom of the first and second legs 302A and 302B of the channel 302C of the molding 300 and act to further secure the molding 300 onto the holder 102.

The sloped front 102A of the holder 102 is provided with a hole 104 extending completely through the holder 102 parallel to the axis A—A of the molding 300 to be bent in the bending apparatus 10. The hole 104 is located such that when the holder 102 is mounted between the enlarged portions 78A and 80A of the inside and outside walls 78 and 80 of the pivotable member 70, the hole 104 of the holder 102 is aligned with the second holes 100 of the pivotable member 70. A pivot rod 106 is provided through the inside wall 78 of the pivotable member 70, through the holder 102 and into the outside wall 80 of the pivotable member 70 to mount the holder 102 on the pivotable member 70. The pivot rod 106 enables the holder 102 to pivot about the second pivot axis C—C (FIGS. 8 and 9). The diameter of the pivot rod 106 is preferably slightly less than the diameter of the hole 104 of the holder 102 such that the holder 102 pivots freely on the pivot rod 106 without extraneous side-to-side motion. The outer surface of the pivot rod 106 is smooth such as to prevent extraneous friction between the rod 106 and the holder 102 during pivoting. Preferably, the pivot rod 106 is of such a length so as to not extend beyond the outside wall 80 or the inside wall 78 when fully in place.

In the preferred embodiment, a spacer 108 is provided on the pivot rod 106 between the outside wall 80 of the pivotable member 70 and the holder 102 (FIG. 10). The spacer 108 acts to prevent contact and thus friction between the holder 102 and the outside wall 80 of the pivotable member 70. The spacer 108 also centers the holder 102 within the pivotable member 70. Preferably, the spacer 108 is constructed from a bronze or similar brazing metal. In addition, a small coil return spring 110 is provided on the pivot rod 106 between the holder 102 and the inside wall 78 of the pivotable member 70. Preferably, the small spring 110 is similar in construction to the large spring 94, only smaller. The small spring 110 is mounted such that the pivot rod 106 extends through the circular center 110A of the smaller spring 110 with the long straight end 110B of the smaller spring 110 extending down at an angle toward the back wall 76 of the pivotable member 70 and stopping adjacent to the bottom wall 72 of the pivotable member 70 and with the short L-shaped end 110C extending down at an angle toward the back wall 76 and beneath the holder 102. The small spring 110 acts to return the holder 102 to the upright position once the pressure of the upper bending member 12 is removed.

A third threaded aperture 112 is provided in the enlarged portion 78A of the outside wall 80 of the pivotable member 70 perpendicular to and directly above the second hole 100 of the outside wall 80 of the pivotable member 70 (FIG. 9). The third aperture 112 is positioned and has a length such that the third aperture 112 intersects with the second hole 100 of the outside wall 80. A second set screw 114 is provided in the third threaded aperture 112 and when fully inserted is adjacent to and in contact with the pivot rod 106. The second set screw 114 acts to prevent the pivot rod 106 from rotating within the second holes 100 of the pivotable member 70. Thus during bending, the pivot rod 106 remains stationary in the second holes 100 of the pivotable member 70 while the holder 102 pivots on the pivot rod 106.

A stopper plate 116 is mounted onto the back wall 76 of the pivotable member 70. The back wall 76 of the pivotable member 70 is provided with a fourth threaded aperture 117 adjacent to the first hole 82 of the back wall 76 and extending perpendicular to the axis A—A of the molding 300 to be bent by the bending apparatus 10. The fourth threaded aperture 117 is spaced above and apart from the first hole 82 of the back wall 76 towards the inside wall 78 of the pivotable member 70 such that the fourth threaded aperture 117 does not intersect with the first hole 82. The fourth threaded aperture 117 is preferably located in the back wall 76 midway between the inside wall 78 and the outside wall 80. The stopper plate 116 is attached by a bolt 118 which extends through an opening in the plate 116 and into the fourth threaded aperture 117 in the back wall 76 of the pivotable member 70. The stopper plate 116 is of a size and is mounted such that the plate 116 extends beyond the back wall 76 of the pivotable member 70 toward the front wall 74 of the pivotable member 70. During pivoting of the holder 102, the stopper plate 116 comes in contact with the top surface 102D of the back edge 102E of the holder 102 and acts to limit the return pivoting of the holder 102 beyond the upright position (FIG. 4). Thus, the stopper plate 116 ensures that the holder 102 will stop at the upright position when the pressure of the upper member is removed.

Figure 11:
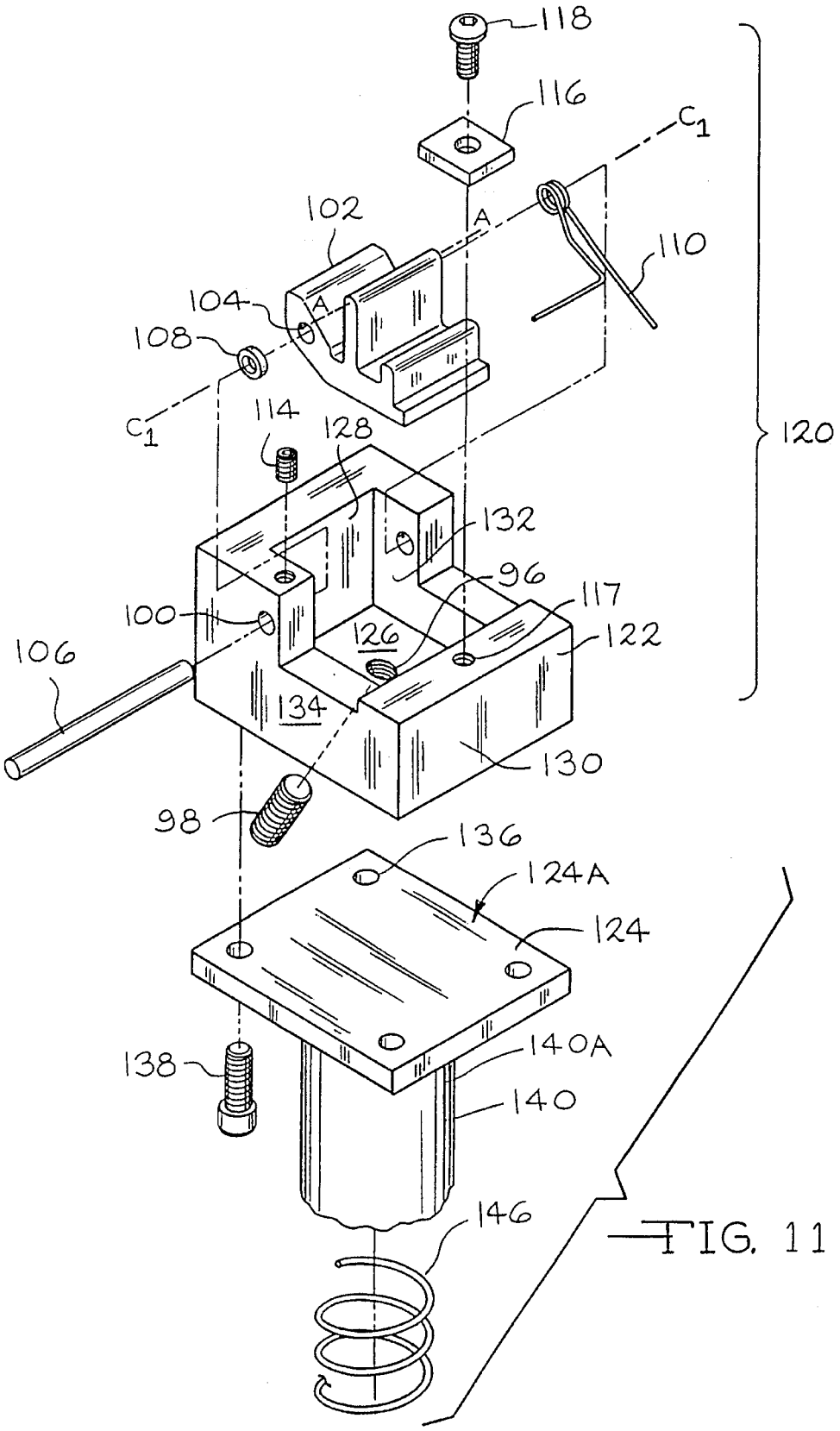
FIG. 11 is an exploded perspective view of the middle tool member 120 showing the fixed member 122 and the mounting plate 124, the hollow shaft 140 and the compression spring 146.

As shown in FIG. 11, the middle tool member 120 is similar to the first and second outer tool members 54 and 56 except that the middle tool member 120 does not have a pivotable member 70 or a housing 58 or any of the other aspects of the outer tool members 54 and 56 which are necessary in order to allow the pivotable members 70 and 71 to pivot. Rather, the middle tool member 120 has a fixed member 122 mounted directly onto a mounting plate 124. The fixed member 122 of the middle tool member 120 is similar in shape and size to the pivotable members 70 and 71 of the outer tool members 54 and 56 and has a bottom wall 126 and a front wall 128 and a back wall 130 with an inside wall 132 and an outside wall 134 extending, therebetween. The bottom edge of the outside wall 134 of the fixed member 122 is not rounded as with the outside wall 80 of the pivotable member 70 of the first outer tool member 54, due to the fact that the fixed member 122 does not pivot. Thus, the inside wall 132 and the outside wall 134 of the fixed member 122 of the middle tool 120 are identical (FIG. 11). The bottom wall 126 of the fixed member 122 is provided with four apertures (not shown) located adjacent to each corner of the fixed member 122. The mounting plate 124 is preferably square with a shape and size similar to the bottom wall 126 of the fixed member 122. The mounting plate 124 has a top surface 124A and a bottom surface (not shown). The mounting plate 124 is provided with four apertures 136 which extend through the mounting plate 124 adjacent the four corners of the plate 124. When correctly mounted, the four apertures in the bottom wall 126 of the fixed member 122 are aligned with the four apertures 136 of the mounting plate 124. The fixed member 122 is secured onto the mounting plate 124 by four bolts 138 (one shown) which extend upward through the apertures 136 in the mounting plate 124 and into the apertures in the bottom wall 126 of the fixed member 122 (FIGS. 10 and 11). The bolts 138 are tightened such as to securely mount the fixed member 122 onto the mounting plate 124. Thus, the fixed member 122 of the middle tool member 120 is unable to pivot.

The bottom surface of the mounting plate 124 is preferably attached to one end 140A of a hollow shaft 140. The other end (not shown) of the shaft 140 is telescopically mounted within one end 142A of a larger hollow tube 142 which is attached to the bottom fixed portion 18B of the press 18 at the other end 142B (FIGS. 2 and 3). A compression spring 146 is provided within the hollow shaft 140 and the hollow tube 142 and is of a length such as to extend the complete length of the hollow shaft 140 and the hollow tube 142 (FIG. 10). Thus, when the upper bending member 12 exerts pressure on the middle tool member 120, the fixed member 122 does not pivot rather the entire middle tool member 120 moves downward. The compression spring 146 acts to return the middle tool member 120 to the original, at rest, position once the pressure of the upper bending member 12 is removed. In the original, at rest, position, the middle tool member 120 is at the same height as the two outer tool members 54 and 56 such that the molding 300 is held in the holders 102 of all three tool members 54, 56 and 120 along axis A—A when in the initial unbent condition. Preferably, the remainder of the middle tool member 120 is identical to the outer tool members 54 and 56. Thus, the holder 102 is pivotably mounted within the fixed member 122 and is able to pivot on a second pivot axis $C_1$—$C_1$ in response to the force of the upper bending member 12 (FIG. 11). Preferably, the second pivot axis $C_1$—$C_1$ of the middle tool member 120 is the same as the second pivot axis C—C of the two outer tool members 54 and 56.

Figure 18:
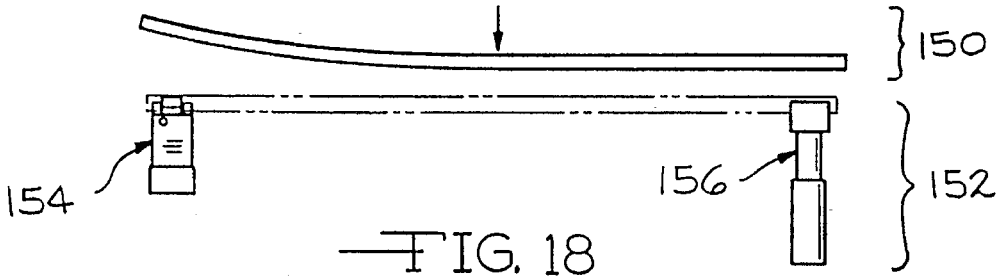
FIG. 18 is a schematic view of an alternate embodiment showing two different tool members 154 and 156 of the lower bending member 152.

In an alternate embodiment as shown in FIG. 18, the lower bending member 152 of the bending apparatus 150 contains only first and second tool members 154 and 156. The first tool member 154 is preferably similar to the two outer tool members 54 and 56 of the preferred embodiment while the second tool member 156 is similar to the middle tool member 120 of the preferred embodiment. The first and second tool members 154 and 156 are positioned at opposite ends 152A and 152B of the lower bending member 152 such that one of the opposed ends 300A and 300B of the molding 300 are held in each of the tool members 154 and 156. This embodiment enables the bending apparatus 150 to provide the molding 300 with a different variety of bends. It is understood that the number and type of tool members used in the lower bending member 152 may be further varied to accomplish many different types of bends.

Figure 12:
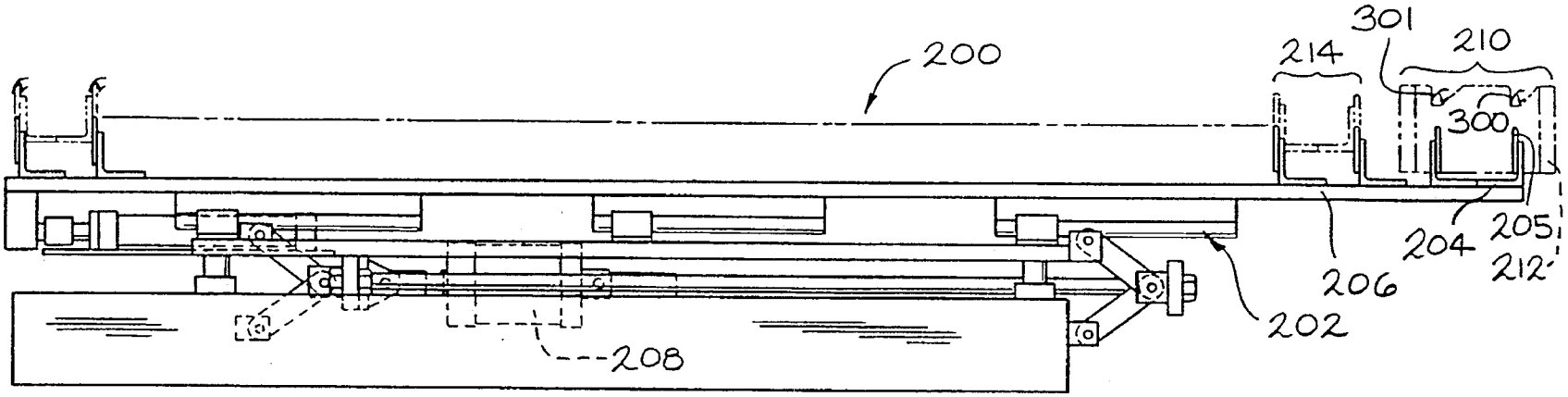
FIG. 12 is a partial side view of the bending and trimming system 200 showing the bar 206 of the conveyor 202 in the lowered, starting position.
Figure 13:
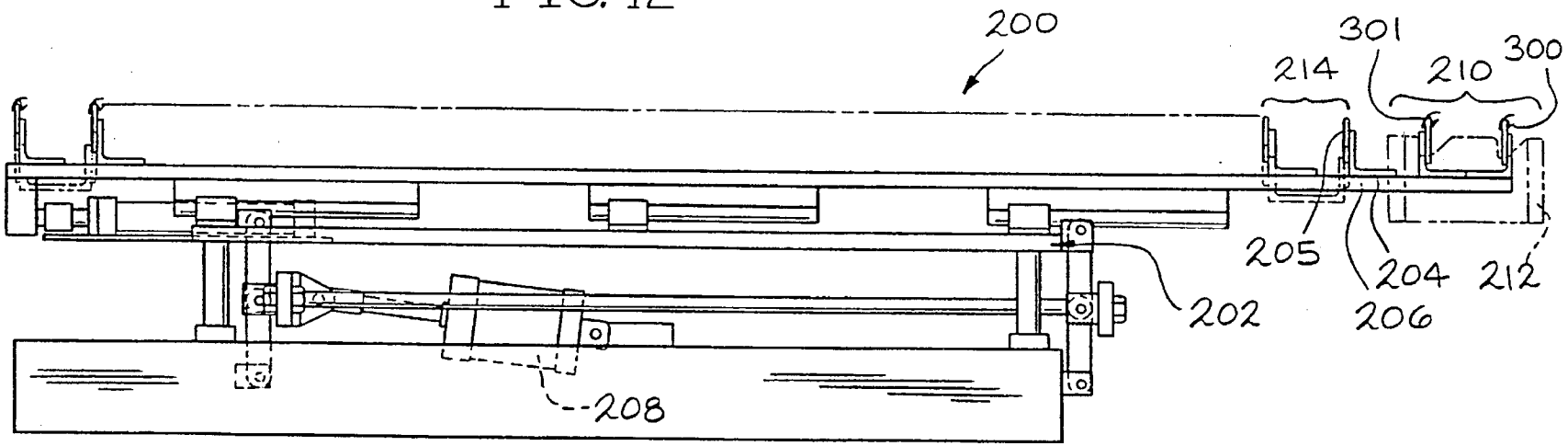
FIG. 13 is a partial side view of the bending and trimming system 200 showing the bar 206 in the elevated, starting position.
Figure 14:
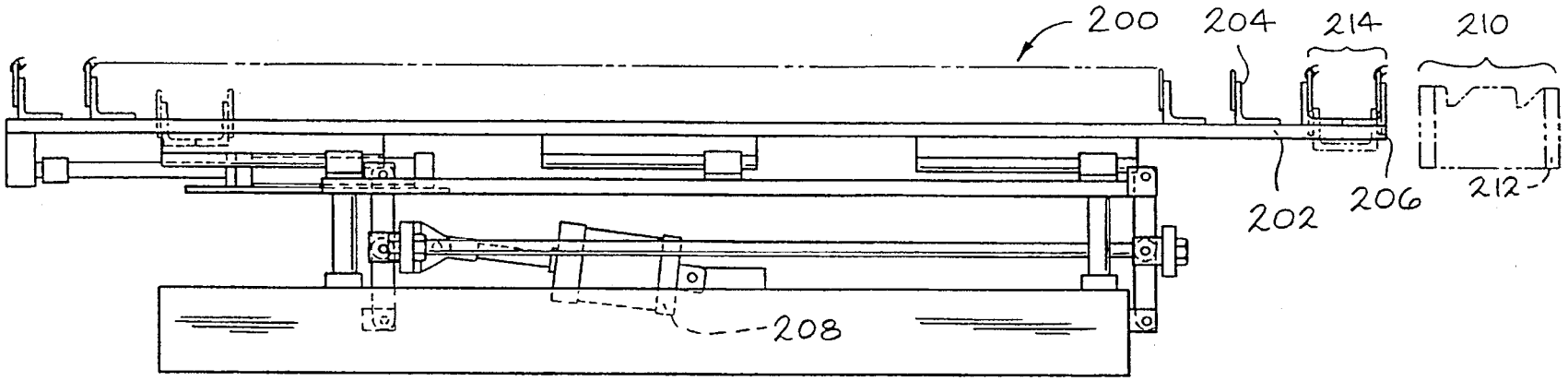
FIG. 14 is a partial side view of the bending and trimming system 200 showing the bar 206 in the elevated, aft position.
Figure 15:
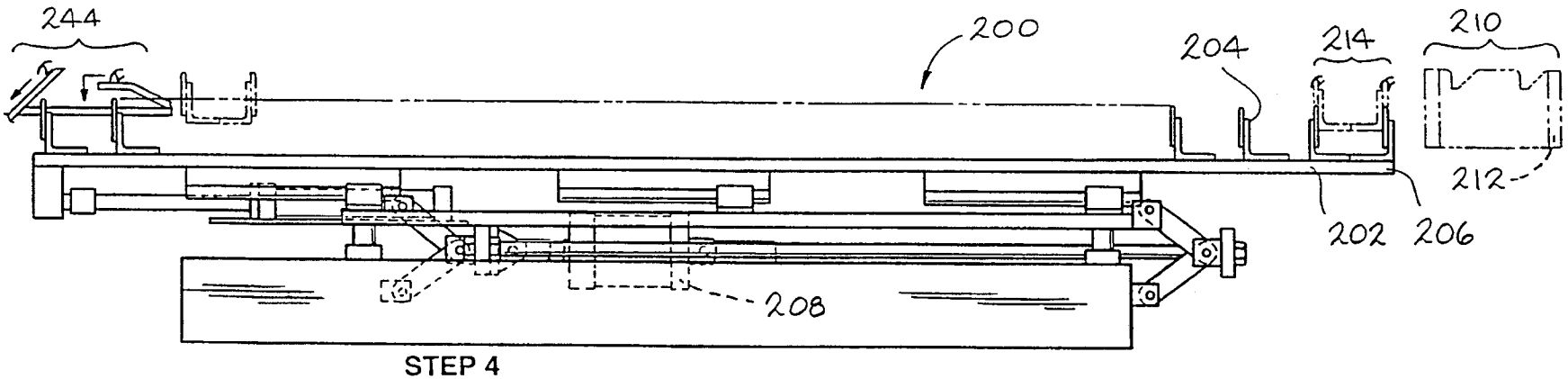
FIG. 15 is a partial side view of the bending and trimming system 200 showing the bar 206 in the lowered, aft position.

A single bending apparatus 10 of the preferred embodiment forms one part of a bending station 224 which is part of a larger bending and trimming system 200 for bending and trimming molding 300 for use on vehicles. The system 200 consists of several stations at which various aspects of the bending and trimming take place. The system 200 is designed to work on the right hand and left hand moldings 300 and 301 simultaneously, thus, each station is equipped to handle two strips of moldings 300 and 301 simultaneously. The bending and trimming system 200 uses a conveyor 202 having two rows of spaced apart fingers 204 having extensions 205 mounted on parallel spaced apart bars 206 which operate in unison to move the moldings 300 and 301 through the system 200. Preferably, the conveyor 202 is similar to conventional lift and carry conveyor systems. FIGS. 12 to 15 show, in stages, the actions of the conveyor 202 which enable the conveyor 202 to move the moldings 300 and 301 through the system 200. Specifically, FIGS. 12 to 15 show the movement of the moldings 300 and 301 from the receiving station 210 to the locating station 214 (to be described in detail hereinafter). The parallel spaced apart bars 206 are positioned on either side of the middle tool member 120 and between the middle tool member 120 and the first and second outer tool members 54 and 56. The bars 206 are connected to first pneumatic cylinder 208 which raises and lowers the bars 206. To move the moldings 300 and 301, the bars 206 are elevated upward such that the extensions 205 of the fingers 204 of the conveyor 202 extend into the channel 302C of the moldings 300 and 301 mounted in guide 212 (FIGS. 13 and 14). The bars 206 continue to elevate until the moldings 300 and 301 are lifted completely free of the guides 212. The bars 206 then move forward a distance of one station (FIG. 14) and descend to deposit the moldings 300 and 301 at the next station (FIG. 15). In the preferred embodiment, the fingers 204 of the conveyor 202 are spaced five inches apart. In a single cycle, the conveyor 202 moves 10 inches one way which moves each piece of molding 300 and 301 ten inches. With the fingers 204 in the lowered position, the bars 206 move backward the distance of one station and return to their original position (FIG. 12). The extensions 205 of the fingers 204 of the conveyor 202 are preferably constructed of a lightweight and durable plastic which will not damage the decorative outer surface 308 of the molding 300 if accidental contact should occur.

The first station of the bending and trimming system 200 is the receiving station 210. At the receiving station 210 of the bending and trimming system 200, the two moldings 300 and 301 are deposited from stock (not shown) into the system 200. The guides 212 of the receiving station 210 act to position each molding 300 or 301 such that the fingers 204 of the conveyor 202 are able to pick up the molding 300 or 301 to move it through the system 200.

Figure 16:
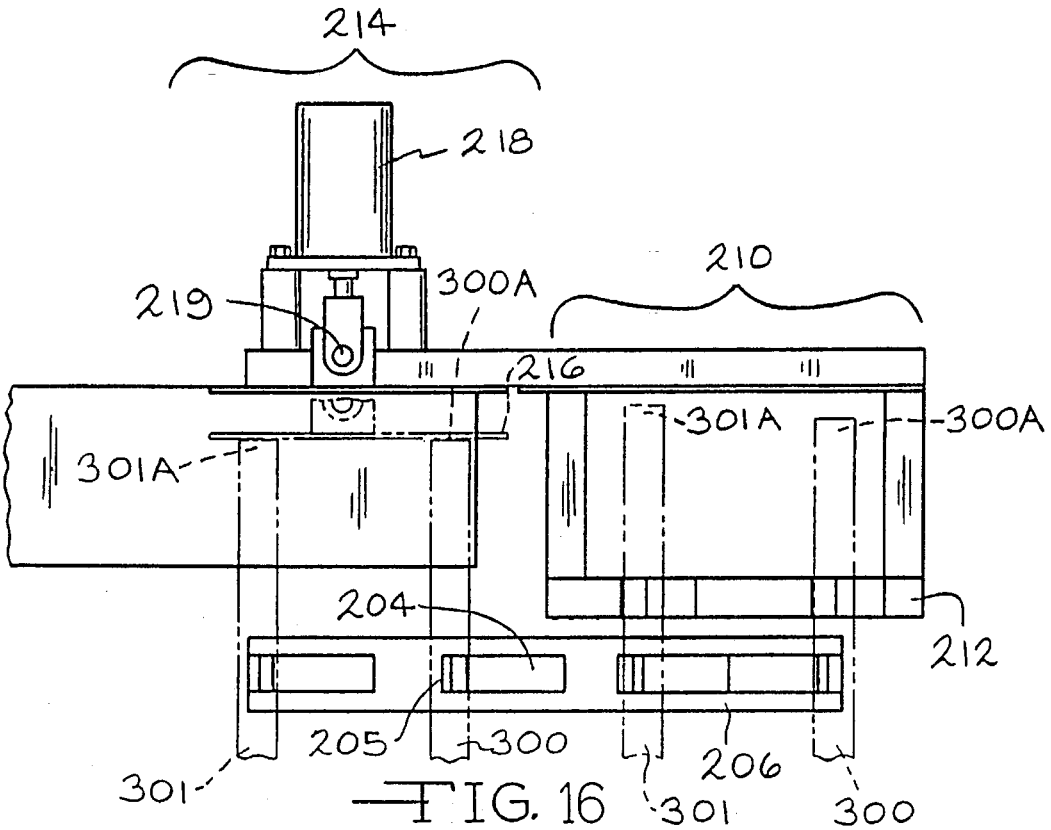
FIG. 16 is a partial plan view of the locating station 214 of the bending and trimming system showing the second pneumatic cylinder 218 and the locating plate 216.

Then, the locating station 214 locates each molding 300 and 301 within the system 200 (FIG. 16). A second pneumatic cylinder 218 having a locating plate 216 is mounted on one side of the system 200 at the locating station 214. The second pneumatic cylinder 218 with the locating plate 216 is mounted outside of the bar 206 of the conveyor 202. Once the molding 300 and 301 is deposited on the locating station 214, the locating plate 216 is activated to make contact with the ends 300A and 301A of the molding 300 and 301. The plate 216 adjusts the moldings 300 and 301 by moving the moldings 300 and 301 such that the opposite ends 300B and 301B of the two moldings 300 and 301 are aligned adjacent a position stop 217 located on the opposite side of the locating station 214 (FIG. 1A). The locating plate 216 is able to pivot on pin 219 in order to accommodate a difference in length as between the two moldings 300 and 301 (FIG. 16). Once the end 300B (one shown) of one molding 300 or 301 makes contact with the position stop 217, the locating plate 216 pivots in order to allow the locating plate 216 to continue to move the other molding 301 or 300 until the end 300B (one shown) of that molding 301 or 300 makes contact with the position stop 217. Consequently, the locating plate 216 is able to move both moldings 300 and 301 until the opposite ends 300B of both moldings 300 and 301 are aligned and in contact with the position stop 217. In this way, both moldings 300 and 301 are located with respect to the system 200. The moldings 300 and 301 are located in the bending and trimming system 200 by aligning only one end 300B of the moldings 300 and 301. It is not possible to align both ends 300A and 301A or 300B and 301B of the moldings 300 and 301 due to the variation in length of the moldings 300 and 301 at this stage of the process.

Figure 17:
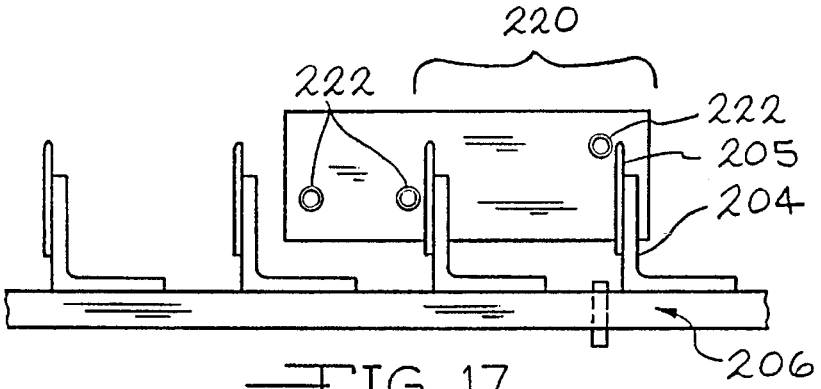
FIG. 17 is a partial side view of the first idle station 220 of the bending and trimming system 200 showing the limit switches 222 and one bar 206 of the conveyor 202 with the fingers 204.

The next station is a first idle station 220. The first idle station 220 is necessary in order to provide space between the locating and bending stations 214 and 224 (to be discussed in detail hereinafter). The first idle station 220 is necessary due to the space required by the tooling of the locating and bending stations 214 and 224. The first idle station 220 is also necessary to reduce the distance the bars 206 of the conveyor 202 must move in order to deposit the moldings 300 and 301 at the next station. Thus, the total distance the bars 206 of the conveyor 202 travel one way, is minimized. The conveyor 202 is provided with limit switches 222 adjacent the first idle station 220 which limit the amount of distance the conveyor 202 moves one way during a single cycle (FIG. 17).

The next station is the, bending station 224. In the preferred embodiment as shown in FIG. 1A, the bending station 224 contains two adjacent bending apparatus 10 and 11 as described above. The two bending apparatus 10 and 11 are preferably spaced apart and parallel to each other. The two bending apparatus 10 and 11 enable the bending station 224 to be used to bend the right-handed molding 300 and the left-handed molding 301, simultaneously. The first bending apparatus 10, spaced in front of the second bending apparatus 11, preferably provides for bending of the right hand molding 300. The second bending apparatus 11 preferably provides for the bending of the left hand molding 301. The two bending apparatus 10 and 11 are identical in construction except for the curvature of the bending surface 14 of the upper bending member 12. Thus, it is understood that the right hand and left hand designations are able to be switched provided the corresponding changes are made to the upper bending members 12. To allow for identical right and left handed bending of the moldings 300 and 301, the curvature of the bending surface 14 of the upper bending member 12 is adjusted equal but opposite for the two bending apparatus 10 and 11. Thus, the curvature of the left half of the right hand bending member is identical to the curvature of the right half of the left hand bending member and the curvature of the right half of the right hand bending member is identical to the curvature of the left half of the left hand bending member. The identical bends at opposite ends of the bending surface 14 are achieved by varying the length of the adjustment units 38 of each upper bending member 12.

To use the bending station 224, the correct curvature for the bending surface 14 of the right and left upper bending members 12 is determined and transferred to the bending surface 14 using the adjustment units 38. The right hand and left hand moldings 300 and 301 are then deposited onto the holders 102 of the three tool members 54, 56 and 120 of the lower bending members 52 by the conveyor 202. Next, the upper bending members 12 of both the right and left handed bending apparatus 10 and 11 are moved downward simultaneously toward their corresponding lower bending members 52. Preferably, the upper bending members 12 of both the right and left hand bending apparatus 10 and 11 are mounted together on the top moving portion 18A of the same press 18 (FIG. 1A). Therefore, the right and left hand bending apparatus operate simultaneously and identically thus, the use of the bending station 224 will only be described with reference to the right hand bending apparatus 10.

As the upper bending member 12 is lowered, the retractable posts 48 of the upper bending member 12 come in contact with the upper sealing lip 304A of the sealing member 304 of the molding 300 causing the molding 300 and the holders 102 to pivot around the second pivot axis C—C. The holders 102 pivot about the second pivot axis C—C toward the back wall 76 of the pivotable members 70. Preferably, the curvature of the bending surface 14 is such that the center portion of the bending surface 14 comes in contact with the molding 300 mounted on the holder 102 of the middle tool member 120 at the same time as the retractable posts 48 at the end 14A of the bending surface 14 come in contact with the molding 300 mounted in the holders 102 of the two outer tool members 54 and 56 along axis A—A of the molding 300 to be bent. The contact between the bending surface 14 and the molding 300 on the middle tool member 120 directly causes the molding 300 and holder 102 of the middle tool member 120 to pivot around the second pivot axis $C_1$—$C_1$. Thus, the retractable posts 48 and the center of the bending surface 14 act to pivot the molding 300 and all three holders 102 simultaneously on axes C—C and $C_1$—$C_1$. The second pivot axes C—C and $C_1$—$C_1$ are in line and parallel with the axis A—A of the molding 300 to be bent in the bending apparatus 10. As the upper bending member 12 continues to move toward the lower bending member 52, the posts 48 of the upper bending member 12 slowly retract into the retraction cylinder 50 until the bending surface 14 of the upper bending member 12 makes contact with the molding 300 in the two outer tool members 54 and 56. At the same time, the middle tool member 120 is slowly moved downward by the force of the upper bending member 12. Although, the retractable posts 48 continue to be in contact with the molding 300, the molding 300 and holders 102 are held in the pivoted position due to the contact between the bending surface 14 of the upper bending member 12 and the molding 300 in all three of the tool members 54, 56 and 120. At this stage, the retractable posts 48 exert little or no force on the molding 300.

As the upper bending member 12 continues to move downward, the pressure on the middle tool member 120 causes the middle tool member 120 to be compressed downward which combined with the pressure on the outer tool members 54 and 56 causes the pivotable members 70 and 71 of the two outer tool members 54 and 56 to pivot inward toward the middle tool member 120 around the first pivot axis B—B perpendicular to axis C—C. The pivoting of the pivotable members 70 and 71 inward on axis B—B prevents excessive stretching of the molding 300 which could cause mars or streaks in the finish of the decorative outer surface 308. The pivoting also prevents the upper bending member 12 from exerting too much pressure on the molding 300 in the middle tool member 120 which could crush the channel 302C of the molding 300. When the pivotable members 70 and 71 of the outer tool members 54 and 56 are fully pivoted, the middle tool member 120 is also fully compressed. Thus, at this point the bending is complete. Bending of the molding 300 occurs as soon as the ends 14A of the bending surface 14 make contact with the molding 300 and continues until the pivotable members 70 and 71 of the two outer tool members 54 and 56 are completely pivoted and the middle tool member 120 is at its lowermost position.

During bending, the molding 300 is pivoted in the tool members 54, 56 and 120 such that the first leg 302A of the core substrate 302 of the molding 300 is adjacent the bending surface 14 of the upper bending member 12. Consequently, the curved, second leg 302B of the core substrate 302 and the decorative outer surface 308 of the molding 300 are on the side opposite the bending surface 14. In the preferred embodiment, the bending surface 14 of the upper bending member 12 has a convex curvature. Thus, the center of the molding 300 which is held in the middle tool member 120 makes contact with the bending surface 14 first. Once the first and second outer tool members 54 and 56 have pivoted and the middle tool member 120 is fully compressed, the continued downward force of the upper bending member 12 causes the molding 300 to bend. As a result of the orientation of the molding 300 in the holders 102 and the structure of the molding 300, the force of the upper bending member 12 on the molding 300 causes differential stretching in the molding 300. The positioning of the curved, second leg 302B of the molding 300 opposite the bending surface 14 causes the second leg 302B to stretch more than the first leg 302A in order to compensate for the extra length needed by the second leg 302B to follow the bend created in the first leg 302A by the upper bending member 12. Although the second leg 302B of the core substrate 302 of the molding 300 is stretched, the outer decorative surface 308 of the molding 300 is not stretched. The decorative surface 308 is secured on the second leg 302B of the core substrate 302 by a roll forming process. Upon stretching of the second leg 302B of the core substrate 302, the decorative outer surface 308 slides along the second leg 302B as the second leg 302B is being stretched. Thus, the decorative surface 308 is not stretched and consequently the finish on the decorative outer surface 308 is not flawed or marred due to stretching. The added length of the second leg 302B beyond the decorative outer surface 308 which results from the stretching which occurs during bending is usually cut off at a later station of the bending and trimming system 200 in order to trim the molding 300 to the correct length. Furthermore, the second leg 302B due to the curved structure has more flexibility than the straight, first leg 302A of the molding 300. Consequently, the first leg 302A of the molding 300 bends at a lower applied force, before the curved, second leg 302B. This differential stretching allows the molding 300 to be provided with a first bend along one axis. The U-shape of the core substrate 302 of the molding 300 also effects the stretching of the molding 300 during bending. The shape of the molding 300 is such that during bending, the top of the core substrate 302 where the first and second legs 302A and 302B of the substrate connect, stretches less than the bottom of the core substrate. This differential stretching enables the molding 300 to be provided with a second bend along a different axis from the first bend. The combination of molding 300 orientation during bending and the structure of the molding 300 enables the bending apparatus 10 to provide the molding 300 with a compound bend.

When bending is complete, the upper bending member 12 is moved upward, away from the lower bending member 52 and pressure is removed from the molding 300. As the pressure is released, the middle tool member 120 returns to the original position as the pivotable members 70 and 71 return to their upright position and the holders 102 return to their upright position. As the upper bending member 12 is moved away, the retractable posts 48 extend downward and keep the molding 300 pivoted until all of the bending surface 14 of the upper bending member 12 has been removed from the molding 300. Thus, the right and left moldings 300 and 301 are provided with compound bends along two different axis without damage to the decorative outer surface 308 of the moldings 300 and 301.

The moldings 300 and 301 are removed from the holders 102 of the bending apparatus 10 and 11 by the fingers 204 of the conveyor 202 and moved to the next station which is the second idle station 226. Again, the second idle station 226 is necessary to provide room for the tooling of the bending station 224, while keeping the travel distance of the conveyor 202 to a minimal.

The next station is the notch station 228. At this station, both ends 300A and 300B and 301A and 301B of the moldings 300 and 301 are provided with notches (not shown). The notches are preferably cut in both ends 300A and 300B and 301A and 301B of the moldings 300 and 301 by a horizontal cam piece (not shown) which punches out the notch in the ends 300A and 300B and 301A and 301B of the moldings 300 and 301. The specific shape of the notch is dependent on the specific use for the moldings 300 and 301. Further, the notches on either end 300A and 300B and 301A and 301B of the moldings 300 and 301 are not necessarily identical. The notches are necessary to provide clearance for the end caps (not shown) which are attached to the ends 300A, 300B, 301A and 301B of the moldings 300 and 301 after exiting the moldings have exited the bending and trimming system 200. The notches also provide a locator wedge for the trimming station 230.

At the next station, the trimming station 230, the ends 300A, 300B, 301A and 301B of the moldings 300 and 301 are trimmed vertically. The trimming station 230 uses the notches cut in one end 300A and 301A or 300B and 301B of the moldings 300 and 301 to locate the part laterally in the trimming station 230.

The next station to act on the moldings 300 and 301 is the cut off station 232. The cut off station 232 is different from the previous stations in that the right and left hand moldings 300 and 301 are not acted on simultaneously. The cut off station 232 includes a left hand cut off 234 coupled with a single right hand idle 236, a right hand cut off 238 coupled with a single left hand idle 240 and a complete idle station 242 located between the left and right hand cut offs 234 and 238. Due to the tooling requirements of the cut off stations 232, the right and left hand cut offs 234 and 238 are spaced apart. Consequently, the right and left hand moldings 300 and 301 are cut separately. The left hand molding 301 is cut first while the right hand molding 300 remains idle in the single right hand idle 236. The single right hand idle 236 is between the trimming station 230 and the left hand cut off 234. The single right idle 236 provides room for the tooling of the left hand cut off 234. By having the left hand cut off 234 first, the total number of times the moldings 300 and 301 must be moved by the conveyor 202 is reduced. The moldings 300 and 301 are then moved to the complete idle station 242. The complete idle station 242 is located between the left and right hand cut offs 234 and 238 and is necessary in order to provide space for the tooling of the right and left hand cut offs 234 and 238. A complete idle station 242 is used in order to correctly position the right hand molding 300 in the right hand cut off 234 during the next cycle of the conveyor. The set up of the cut off station 232 is necessary due to the total one way distance traveled by the conveyor 202 and due to the right and left moldings 300 and 301 being treated simultaneously in the rest of the bending and trimming system 200.

The cut off station 232 acts to cut the moldings 300 and 301 to the correct length by horizontally cutting off both ends 300A and 301A and 300B and 301B of the moldings 300 and 301. Preferably, there is less than a ¼ inch error on either end of the moldings 300 and 301. This small margin of error reduces the amount of waste produced by the bending and trimming system 200.

Finally, the moldings 300 and 301 are moved by the conveyor 202 to the unload station 244. Preferably, the unload station 244 is similar to the conventional unload stations used with similar conveyors. The unload station 244 preferably separates the right hand moldings 300 from the left hand moldings 301 and deposits them in separate bins (not shown).

The bending and trimming system 200 of the preferred embodiment is constructed to produce a specific shape of moldings 300 and 301 for a particular use. It is understood that the bending apparatus 10 and 11 may be used in other bending and trimming systems used to produce a variety of different sized and shaped moldings having compound bends. Further, the bending apparatus 10 and 11 may be used as a free standing, independent bending machine.

Numerous variations will occur to those skilled in the art and it is intended that the present invention be limited only by the hereinafter appended claims.

We claim:

1. A method for bending of an elongate strip having opposed ends and a length between the opposed ends defining an axis of the strip to produce an arcuate shape along the length of a deformable material which comprises:

(a) providing in a driving means a pair of spaced apart bending members which are moved together to bend the strip and then are moved apart, a first one of the bending members having an arcuate surface for bending the strip to form a bend in the strip when the bending members are moved together; and a second one of the bending members comprising at least two tool members mounted along the axis defined by the strip when the bending members are apart and wherein each of the tool members has holders which mount the strip, wherein at least one of the holders is pivotable around a holder axis parallel to the axis of the strip and is biased such that the strip mounted in the holder is urged towards the arcuate surface of the first one of the bending members, wherein the holder also rotates around the holder axis parallel to the axis of the strip prior to or during bending, wherein the bending members rotate the strip on the one of the holders which is pivotable and move against the bias of the one of the holders to deform the strip as the bending members are moved together;

(b) providing the strip between the bending members mounted on the holders;

(c) moving the bending members together to bend the strip, wherein the arcuate surface has a bend which is greater than the arcuate shape to be produced in the strip; and (d) moving the bending members apart, wherein the strip straightens to a curve which is less than the arcuate shape.

2. The method of claim 1 wherein the strips are conveyed between, mounted on the holders and then conveyed from the bending members by a conveying means.

3. The method of claim 2 wherein the first bending member has at least one retractable post through the arcuate surface with a distal end which projects towards the second one of the bending members so that the distal end of the post is in a straight line across a lowermost portion of the arcuate surface of the first one of the bending members along the axis of the strip and wherein the post contacts and rotates the strip around the holder axis parallel to the axis of the strip as the bending members are moved together.

4. The method of claim 3 wherein the strip has a channel along the length of the strip and wherein fingers are provided on each of the holders for the strip which project into the channel and wherein the fingers support the strip during the bending.

5. The method of claim 4 wherein the strip is a window channel for a vehicle and wherein the fingers on the holders are adapted to mount the window channel.

6. The method of claim 5 wherein the strip is a composite of a rubber window seal, a metal channel and a coated decorative surface along the length of the strip and wherein the post engages the rubber window seal as the bending members are moved together and rotates the strip around the holder axis parallel to the axis of the strip such that the tool members and arcuate surface are free of contact with the decorative surface during the bending.

7. A method for bending of an elongate strip having opposed ends and a length between the opposed ends defining an axis of the strip to produce an arcuate shape along the length of a deformable material which comprises:

(a) providing in a driving means a pair of spaced apart bending members which are moved together to bend the strip and then are moved apart, a first one of the bending members having an arcuate surface for bending the strip to form a bend in the strip when the bending members are moved together; and a second one of the bending members comprising at least three tool members with two of the tool members positioned on opposed sides of the third tool member and mounted along the axis defined by the strip when the bending members are apart, wherein the third tool member is biased towards the arcuate surface, wherein each of the tool members has holders which mount the strip, wherein at least one of the holders is pivotable around a holder axis parallel to the axis of the strip and is biased such that the strip mounted in the holder is urged towards the arcuate surface of the first one of the bending members, wherein the holder also rotates around the holder axis parallel to the axis of the strip prior to or during bending, wherein the bending members rotate the strip on the one of the holders which is pivotable and move against the bias of one of the holders to deform the strip as the bending members are moved together;

(b) providing the strip between the bending members mounted on the holders;

(c) moving the bending members together to bend the strip, wherein the arcuate surface has a bend which is greater than the arcuate shape to be produced in the strip; and (d) moving the bending members apart, wherein the strip straightens to a curve which is less than the arcuate shape.

8. The method of claim 7 wherein the strips are conveyed between the bending members, mounted on the holders of the second one of the bending members and then conveyed from the bending members by a conveying means.

9. The method of claim 8 wherein the first bending member has at least one retractable post through the arcuate surface with a distal end which projects towards the second one of the bending members so that the distal end of the post is in a straight line across a lowermost portion of the arcuate surface of the first one of the bending members along the axis of the strip and wherein the post contacts and rotates the strip around the holder axis parallel to the axis of the strip as the bending members are moved together.

10. The method of claim 9 wherein the strip has a channel along the length of the strip and wherein fingers are provided on each of the holders for the strip which project into the channel and wherein the fingers support the strip during the bending.

11. The method of claim 10 wherein the strip is a window channel for a vehicle and wherein the fingers on the holders are adapted to mount the window channel.

12. The method of claim 11 wherein the strip is a composite of a rubber window seal, a metal channel and a coated decorative surface along the length of the strip and wherein the post engages the rubber window seal as the bending members are moved together and rotates the strip around the holder axis parallel to the axis of the strip such that the tool members and arcuate surface are free of contact with the decorative surface during the bending.

* * * * *